US009776098B2

(12) United States Patent
Fair et al.

(10) Patent No.: US 9,776,098 B2
(45) Date of Patent: Oct. 3, 2017

(54) PILLOW WITH TOY ATTACHMENT SYSTEM

(75) Inventors: Paul Fair, Denver, CO (US); Kristin A. Tidwell, Denver, CO (US); Catherine P. McNeil, Golden, CO (US); Clarice Bonzer, Littleton, CO (US)

(73) Assignee: The Boppy Company, LLC, Golden, CO (US)

( * ) Notice: Subject to any disclaimer, the term of this patent is extended or adjusted under 35 U.S.C. 154(b) by 957 days.

(21) Appl. No.: 12/827,870

(22) Filed: Jun. 30, 2010

(65) Prior Publication Data

US 2011/0154572 A1 Jun. 30, 2011

Related U.S. Application Data

(63) Continuation-in-part of application No. 12/619,481, filed on Nov. 16, 2009.

(51) Int. Cl.
*A63H 33/00* (2006.01)

(52) U.S. Cl.
CPC ..... *A63H 33/006* (2013.01); *Y10T 29/49947* (2015.01)

(58) Field of Classification Search
USPC ..... 446/227, 107; 5/655, 639, 640; 248/229.16, 231.81
See application file for complete search history.

(56) References Cited

U.S. PATENT DOCUMENTS

| | | | | |
|---|---|---|---|---|
| 2,317,176 A | | 4/1943 | Byrd | |
| 2,723,856 A | | 11/1955 | Thomson | |
| 2,831,538 A | * | 4/1958 | Lishman | 160/330 |
| 2,884,638 A | | 5/1959 | Ream | |
| 3,298,648 A | * | 1/1967 | Sepanski | 5/655 |
| 3,365,198 A | | 1/1968 | Hay | |
| 3,493,228 A | * | 2/1970 | Hicks et al. | 5/655 |
| 3,665,880 A | | 5/1972 | Ambrose | |
| D231,810 S | | 6/1974 | Daley | |

(Continued)

FOREIGN PATENT DOCUMENTS

| | | |
|---|---|---|
| DE | 41134439 A1 | 4/1993 |
| EP | 1 031 364 B1 | 6/2005 |
| WO | WO 03/084369 A1 | 10/2003 |

OTHER PUBLICATIONS

Bebe Chic Products, http://www.bebechic.com/strollers.asp, downloaded Aug. 24, 2010, 1 page.

(Continued)

*Primary Examiner* — Aarti B Berdichevsky
*Assistant Examiner* — Urszula M Cegielnik
(74) *Attorney, Agent, or Firm* — Kilpatrick Townsend & Stockton LLP

(57) ABSTRACT

A pillow includes a compressible fill material and a flexible shell covering the fill material. A track is at least partially embedded in the flexible shell, and a clip is slidingly engaged with the track. The clip defines an opening for attaching an item to the pillow. Various kinds of items may be attached. In another variation, a slipcover includes a flexible shell configured to conform to an outer shape of a particular pillow, and also includes a track at least partially embedded in the flexible shell. A clip is slidingly engaged with the track and defines an opening.

33 Claims, 20 Drawing Sheets

(56) References Cited

U.S. PATENT DOCUMENTS 4,040,126 A 8/1977 Cecil
4,188,745 A 2/1980 Harvey et al.
4,463,464 A * 8/1984 Bost et al. ..... 297/452.61
4,542,714 A 9/1985 Ingraham et al.
4,594,072 A 6/1986 Cowell
4,627,588 A 12/1986 Block
4,654,991 A * 4/1987 Jones ..... 40/617
4,702,719 A 10/1987 Lapid
4,722,713 A 2/1988 Williams et al.
4,737,129 A 4/1988 Gorley et al.
4,771,493 A * 9/1988 Park ..... 5/640
4,954,114 A 9/1990 Kawashima
5,045,871 A 9/1991 Reinholdson
5,056,533 A * 10/1991 Solano ..... 5/655
5,150,504 A 9/1992 Cohen
5,187,826 A 2/1993 Mariol
5,261,134 A 11/1993 Matthews
5,546,620 A * 8/1996 Matthews ..... 5/655
5,702,039 A 12/1997 Olaiz
5,928,054 A 7/1999 Mast
5,930,854 A * 8/1999 O'Neill et al. ..... 5/655
6,003,213 A 12/1999 Keller et al.
6,016,926 A 1/2000 Smith, II et al.
6,036,263 A 3/2000 Gold
6,038,720 A 3/2000 Matthews et al.
6,055,687 A 5/2000 Matthews
6,109,765 A 8/2000 Blanton
6,142,565 A 11/2000 Rieder
6,168,494 B1 1/2001 Engel et al.
6,178,978 B1 1/2001 Rieber
6,279,185 B1 8/2001 Matthews
6,321,403 B1 11/2001 Matthews
6,357,462 B1 3/2002 Laosunthara et al.
6,374,468 B1 4/2002 Cardwell, III et al.
6,412,128 B1 7/2002 Matthews
6,428,098 B1 8/2002 Allbaugh
6,434,770 B2 8/2002 Matthews Brown
6,436,125 B1 8/2002 Rhoads
6,439,947 B1 8/2002 Lehavi
6,442,759 B1 9/2002 Straham, Jr. et al.
6,453,493 B1 * 9/2002 Matthews Brown ..... 5/636
6,491,563 B1 12/2002 Bailey
6,532,612 B2 3/2003 Matthews Brown
6,592,425 B2 7/2003 Bapst et al.
6,625,828 B2 * 9/2003 Matthews Brown ..... 5/636
6,640,977 B2 11/2003 Matthews Brown et al.
6,671,908 B2 1/2004 Brown et al.
6,684,422 B2 2/2004 LeFevre et al.
6,685,024 B1 2/2004 Matthews
6,702,381 B2 3/2004 Endicott et al.
6,752,457 B2 6/2004 Gold et al.
6,763,539 B1 7/2004 Bartley et al.
6,785,921 B1 * 9/2004 Conforti ..... 5/655
6,810,545 B1 * 11/2004 Darling et al. ..... 5/655
6,851,143 B2 * 2/2005 Matthews Brown ..... 5/490
6,857,150 B2 2/2005 Matthews Brown et al.
6,860,786 B2 3/2005 Oren et al.
RE38,782 E * 8/2005 Dix ..... 5/482
6,938,958 B2 9/2005 Gold et al.
6,944,898 B2 9/2005 Matthews Brown et al.
6,966,089 B2 11/2005 Gold et al.
7,000,274 B2 * 2/2006 Matthews Brown et al. .... 5/636
7,000,275 B2 2/2006 Matthews Brown et al.
7,000,766 B2 2/2006 Matthews Brown et al.
7,017,212 B2 3/2006 Matthews Brown
7,029,066 B1 * 4/2006 Myers-Jones ..... 297/219.1
7,037,170 B2 5/2006 Pacella et al.
7,055,196 B2 6/2006 Littlehorn
7,062,807 B2 * 6/2006 Conforti ..... 5/655
7,086,545 B2 8/2006 Mannion et al.
7,089,639 B2 8/2006 Matthews Brown et al.
7,096,874 B2 8/2006 Forshpan
7,127,760 B2 10/2006 Bartley et al.
7,146,663 B2 12/2006 Brown et al.
7,201,177 B2 4/2007 Anticoli et al.
7,219,373 B2 5/2007 McNamara
7,290,303 B2 * 11/2007 Mead et al. ..... 5/655
7,311,357 B2 12/2007 Gold et al.
7,331,073 B2 2/2008 Littlehorn et al.
7,374,240 B2 5/2008 Gold et al.
7,376,993 B2 5/2008 Myers et al.
7,404,222 B2 7/2008 Tidwell
7,430,765 B2 10/2008 Brown et al.
7,430,774 B2 10/2008 Littlehorn et al.
7,451,508 B2 11/2008 Matthews Brown et al.
7,461,421 B1 * 12/2008 Faircloth et al. ..... 5/639
7,472,443 B2 1/2009 Littlehorn et al.
7,587,773 B2 9/2009 Littlehorn et al.
7,588,291 B2 9/2009 Gold et al.
7,624,461 B2 * 12/2009 Tidwell et al. ..... 5/655
7,636,949 B1 12/2009 Shooshan
7,762,413 B2 7/2010 Song
7,788,752 B2 9/2010 Tidwell et al.
7,810,191 B2 10/2010 Littlehorn et al.
7,832,036 B2 11/2010 Littlehorn et al.
8,336,173 B2 * 12/2012 Pontaoe et al. ..... 24/537
2001/0038203 A1 * 11/2001 Henderson et al. ..... 281/51
2002/0020021 A1 2/2002 Milano et al.
2004/0052579 A1 3/2004 Draggoo et al.
2004/0063381 A1 4/2004 Norman
2004/0232756 A1 11/2004 Lin
2004/0266312 A1 12/2004 Oren et al.
2005/0204471 A1 * 9/2005 Ruiz ..... 5/420
2005/0223492 A1 10/2005 Littlehorn et al.
2006/0183397 A1 * 8/2006 Kanahele et al. ..... 446/26
2006/0199467 A1 9/2006 Snyder et al.
2006/0232112 A1 10/2006 Karr
2006/0264148 A1 11/2006 Sejnowski et al.
2007/0080183 A1 * 4/2007 Lafoux et al. ..... 224/153
2007/0087657 A1 * 4/2007 Campbell et al. ..... 446/482
2007/0178799 A1 8/2007 Rudell et al.
2007/0192961 A1 8/2007 Tidwell et al.
2008/0248713 A1 10/2008 Mulrine et al.
2008/0258437 A1 10/2008 Ryan et al.
2009/0253342 A1 10/2009 Oren et al.
2012/0100776 A1 4/2012 Jackson et al.

OTHER PUBLICATIONS

Boo Yah Baby—Stroller Liners, http://booyahbaby.com/Stroller-Liners/, downloaded Aug. 24, 2010, 4 pages.
Bumbleride—The Ride of Your Life, http://www.bumbleride.com/strollers/footmuff.php, downloaded Aug. 24, 2010, 1 page.
Clean Shopper Shopping Cart Covers, http://www.cleanshopper.com/static.php?page=shopping_cart_covers, downloaded Aug. 24, 2010, 3 pages.
Eddie Bauer Reversible Stroller Liner, http://www.target.com/dp/B0033A42L2/ref=gp_se_search-results-asin-redirect, downloaded Aug. 24, 2010, 2 pages.
Eddie Bauer Shopping Cart Cover, http://www.toysrus.com/product/index.jsp?productId=3697563, downloaded Aug. 24, 2010, 2 pages.
Floppy Seat Shopping Cart Cover and Restaurant High Chair Cover for Babies,http://www.floppyseat.com/index.html, downloaded Aug. 24, 2010, 3 pages.
Infantino, http://www.infantino.com/ShoppingCartCovers/Shopping CartCovers.php, downloaded Aug. 24, 2010, 1 page.
Koochy-Kooz, Cozy Stroller Liners, http://koochykooz.com/main.html, downloaded Aug. 24, 2010, 4 pages.
Luxury Stroller Liners/Stroller Pads, http://www.tivolicoutre.com/Luxury-Stroller-Liners-Stroller-Pads.htm, downloaded Aug. 24, 2010; 2 pages.
myMonkeymoo—Stroller Pads, http://mymonkeymoo.com/stroller-pads.html, downloaded Aug. 24, 2010, 1 page.
Prop 'R Shopper, http://leachco.stores.yahoo.net/proprshopper.html, downloaded Aug. 24, 2010, 1 page.
Pure Joy Collection—Stroller Liners, http://purejoycollection.com/Stroller...Liners.html, downloaded Aug. 24, 2010, 3 pages.

(56) References Cited

OTHER PUBLICATIONS

International Search and Written Opinion of PCT/IB2010/002382 dated Apr. 1, 2011, 11 pages.

* cited by examiner

PILLOW WITH TOY ATTACHMENT SYSTEM

This application is a continuation-in-part of U.S. patent application Ser. No. 12/619,481, titled "Toy Attachment Systems and Methods" and filed Nov. 16, 2009, the entire disclosure of which is hereby incorporated by reference herein.

CROSS REFERENCE TO RELATED APPLICATIONS

This application is related to application Ser. No. 14/178,635, filed on the same day as this application and assigned to the same assignee as this application and titled "Shopping Cart Liner with Toy Attachment System", the entire disclosure of which is hereby incorporated by reference herein. This application is also related to application Ser. No. 12/827,823, filed on the same day as this application and assigned to the same assignee as this application and titled "Stroller Liner with Toy Attachment System", the entire disclosure of which is hereby incorporated by reference herein.

BACKGROUND OF THE INVENTION

Various kinds of equipment and accessories have been developed for facilitating the care of infants and young children. While safety is of primary importance, it is also desirable that child care equipment contribute to the mental and physical development of the child, provide stimulation and entertainment for the child, and be convenient to use.

BRIEF SUMMARY OF THE INVENTION

In some embodiments, a pillow includes a compressible fill material, a flexible shell covering the compressible fill material, a track at least partially embedded in the flexible shell, and at least one clip slidingly engaged with the track, the clip defining an opening for attaching an item to the pillow The clip may include a generally toroidal body and a slotted passage through the generally toroidal body, the passage configured to fit over the track, and the slot in the passage oriented the generally perpendicular to the generally toroidal body. The track may be a semi-rigid rod having a substantially circular cross section. In some embodiments, the track is at least partially embedded by wrapping it in a fabric sleeve that is part of the flexible shell. The track may be at least partially embedded in a seam of the flexible shell. In some embodiments, the flexible shell is a fabric shell. The pillow may be used in combination with an item attached to the pillow via the clip. The item may include an item selected from the group consisting of a toy, a doll, a ball, a mirror, a block, a pyramid, a teething ring, a toy shaped like an animal or insect, a toy shaped like a plant or flower, an item that generates sound, an item that generates vibration, and an item that generates light. In other embodiments, the pillow may be used in combination with an item to be attached to the pillow, the item comprising a main body larger than the opening in the clip, and the item including a compressible member connected to the main body, wherein the compressible member is larger than the opening when the compressible member is in an uncompressed state, and the compressible member is configured to be compressible to a size smaller than the opening so that the compressible member can be passed through the opening to place the compressible member and the main body on opposite sides of the opening.

The pillow may be generally arc shaped, having two curved arms extending from a midsection, to define an open well.

According to other embodiments, a method of attaching an item to a pillow includes providing a pillow that includes a flexible shell covering a compressible fill material. The pillow further includes a track at least partially embedded in a flexible shell and a clip slidingly engaged with the track, the clip defining an opening for attaching an item to the slipcover, and the method further includes providing an item to be attached to the pillow and attaching the item to the pillow via the clip.

According to other embodiments, a slipcover for a pillow includes a flexible shell configured to conform to an outer shape of a particular pillow, a track at least partially embedded in the flexible shell, and a clip slidingly engaged with the track, the clip defining an opening for attaching an item to the slipcover. The slipcover may be used in combination with an item attached to the slipcover via the clip. The slipcover and item may further be used in combination with a pillow to which the flexible shell is configured to conform. The item may include an item selected from the group consisting of a toy, a doll, a ball, a mirror, a block, a pyramid, a teething ring, a toy shaped like an animal or insect, a toy shaped like a plant or flower, an item that generates sound, an item that generates vibration, and an item that generates light. In some embodiments, the slipcover may be used in combination with an item to be attached to the slip cover, the item comprising a main body larger than the opening in the clip, and the item including a compressible member connected to the main body, wherein the compressible member is larger than the opening when the compressible member is in an uncompressed state, and the compressible member is configured to be compressible to a size smaller than the opening so that the compressible member can be passed through the opening to place the compressible member and the main body on opposite sides of the opening. The flexible shell of the slipcover may be a fabric shell.

According to other embodiments, a method of attaching an item to a pillow includes providing a pillow, and providing a slipcover configured to generally conform to and cover the outer shape of the pillow, the slipcover including a track at least partially embedded in a flexible shell of the slipcover and a clip slidingly engaged with the track, the clip defining an opening for attaching an item to the slipcover. The method further comprises inserting the pillow into the slipcover, providing an item to be attached to the slipcover, and attaching the item to the slipcover via the clip. The method may further include adjusting the position of the item by sliding the clip along the track. In some embodiments, attaching the item to the slipcover via the clip further includes compressing a compressible member of the item, passing the compressible member through the opening in the clip, and allowing the compressible member to re-expand.

DETAILED DESCRIPTION OF THE INVENTION

Embodiments of the invention include systems and methods of attaching toys or other items to child care equipment, and include pieces of child care equipment having features for attaching toys or other items.

In some embodiments, the piece of child care equipment is configured to include a track, such as a rod, and a sliding member that moves along the track. The sliding member is configured so that one or more toys or other items can be easily and releasably attached to it. Toys or other attached items can be interchanged and moved to different locations as desired. For example, the track may be suspended above a baby in a play gym, and toys hanging from the track may be moved to be within the baby's reach. The track may also be part of another kind of equipment, such as a pad or pillow, and attached toys or other items can be moved to a location where the child is lying. Other kinds of attachments may also be provided. The track may be completely embedded within the piece of equipment, such as within a fabric sleeve, with the clip sliding over a fabric sleeve. Alternatively, the track may be coupled to the equipment such that the track remains exposed. In this way, the clip slides directly over the track.

Figure 1A:
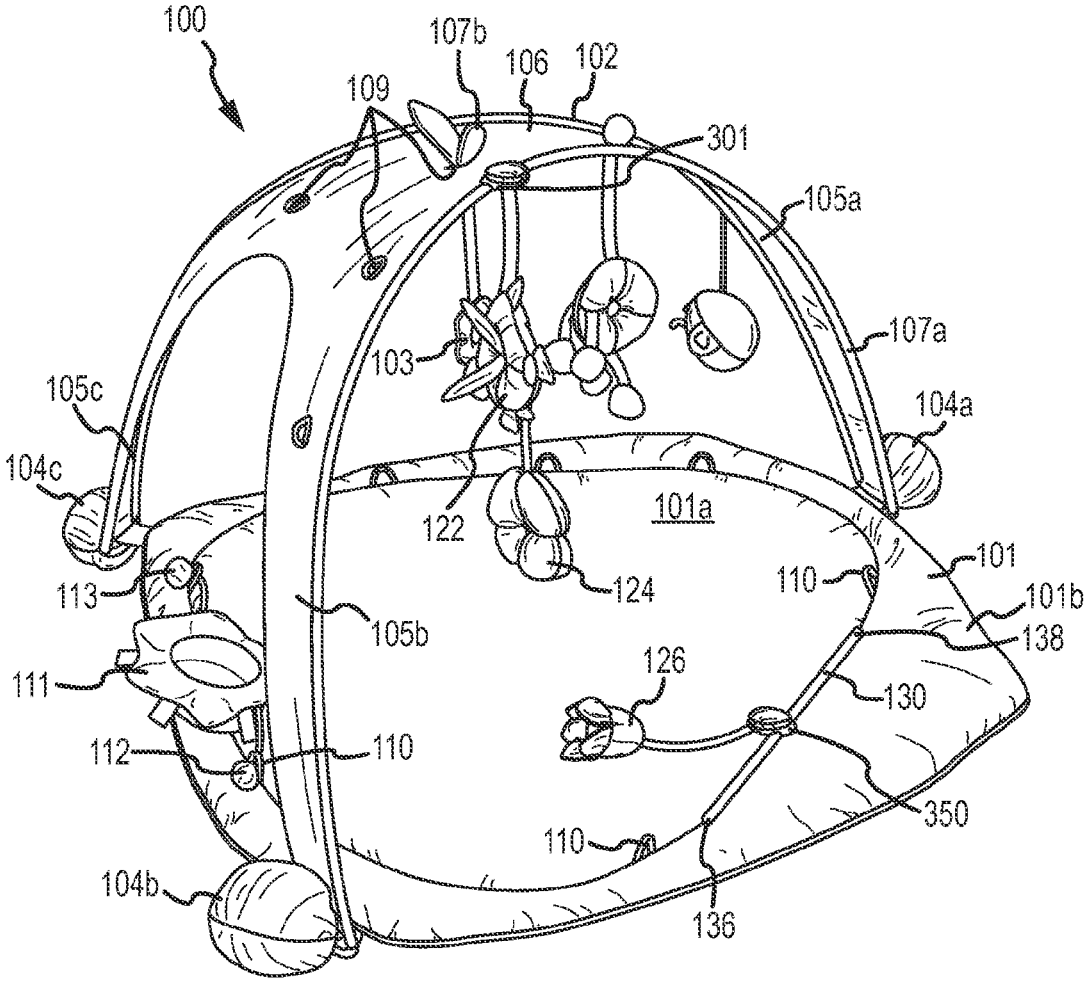
FIG. 1A shows an infant play gym in accordance with embodiments of the invention.

For example, FIG. 1A shows an infant play gym 100 in accordance with embodiments of the invention. Play gym 100 comprises a base pad 101, and a canopy 102. In one mode of use, play gym 100 is placed on a floor. Base pad 101 includes a padded center portion 101*a* and a padded peripheral portion 101*b* that forms an outer boundary for holding the baby. A seam is formed between portions 101*a* and 101*b* where the fabric from each of the portions is joined together. One convenient way to construct base pad 101 is by placing a batting on the fabric, then sewing the fabric together to form the various seams. The stitching between center portion 101*a* and peripheral portion 101*b* serves to limit the amount of shifting of the fill material. An infant is placed on base pad 101, and may interact with various toys or other items such as item 103 suspended from canopy 102 or attached to base pad 101. Play gym 100 thus provides a safe, comfortable, and convenient place for the baby to spend time, and also provides stimulation for the baby's entertainment and development. Play gym 100 may be especially useful for the care of infants who have not yet begun to crawl. Having items attached to play gym 100 keeps the baby's toys in a contained area and within the baby's reach.

Base pad 101 may be, for example, made of a soft cloth or fabric, and may be filled with padding such as foam or fiberfill padding or batting. Base pad 101 is preferably of a size suitable for holding a baby. For example, base pad 101 may be about 30 to 36 inches across, but other larger or smaller sizes may be used. Base pad 101 may be of any suitable shape, including round, oval, oblong, rectangular, or another shape.

Base pad 101 includes three attachment members 104*a-c* affixed to an edge portion of base pad 101. One of skill in the art will recognize that more attachment members may be provided. Attachment members 104*a-c* may be, for example, fabric-covered foam or fiberfill material in a ball shape, or another suitable shape. While attachment members 104*a-c* are preferably compressible, substantially rigid shapes could be used as well, for example plastic balls. Each of attachment members 104*a-c* may be affixed to base pad 101 by sewing a portion of the covering of the respective attachment member into an edge seam of base pad 101, by sewing a tether to both the attachment member and base pad 101, or by any other suitable means.

Canopy 102 is configured to arch over base pad 101, standing on three legs 105*a-c*, forming an arched support frame. Canopy 102 may reach a height of, for example, 12-24 inches over base pad 101, and may be used to hang toys or other items 103 within reach of a baby placed in play gym 100. One of skill in the art will recognize that more legs and other dimensions could be used. Canopy 102 comprises a surface sheet 106, which may be, for example, a fabric or plastic sheet, and may be of a single thickness, or comprise multiple thicknesses of one or more materials. Surface sheet 106 may be made of multiple pieces integrated together, and the pieces need not be of the same materials. Canopy 102 also includes at least two semi-rigid rods 107*a* and 107*b* embedded within canopy 102. Semi-rigid rods 107*a* and 107*b* may be, for example, made of a plastic, metal, or composite material, and may be round or another shape in cross section. Semi-rigid rods 107*a* and 107*b* are preferably stiff enough to remain substantially straight when unstressed, to lightly resist bending, and to regain substantial straightness when any bending force is removed. In one example embodiment, rods 107*a* and 107*b* are each about 28 inches long and about ¼ inch in diameter, and are made of unreinforced plastic. Other appropriate sizes may be used.

First ends of both rods 107*a* and 107*b* follow a first leg 105*a* of canopy 102 to its connection with base pad 101. Preferably, rods 107*a* and 107*b* are embedded within edges of surface sheet 106, but other placements may be used. A second end of first rod 107*a* also follows second leg 105*b* to its connection with base pad 101, and a second end of second rod 107*b* follows third leg 105*c* to its connection with base pad 101. Rods 107*a* and 107*b* thus support canopy 102 by virtue of their stiffness, similar to the way a tent may be supported by tent poles.

As described in greater detail hereinafter with reference to FIG. 3A, a clip 301 is slidingly engaged with rod 107*a*. Clip 301 may slide anywhere along rod 170*a* to adjust the position of one or more toys that are coupled to clip 301. This provides a convenient way for a caregiver to adjust the location of a toy relative to a child. For example, when removing the child from base pad 101, when changing a diaper or cleaning the baby, the caregiver can simply slide clip 301 along rod 107*a* to afford better access into the interior of the tent. To keep the child entertained, slip 301 may be slid such that the toy hangs over the arched support. Although shown attached to rod 107*a*, it will be appreciated that clip 301 may be coupled to any of the rods. Moreover, multiple clips could be attached to a single rod. Also, multiple toys may be chained together, such as toys 122 and 124 of FIG. 1A, to increase the length of the toy and provide a different arrangement for the toys that are suspended from base pad 101.

Base pad 101 may also include one or more tracks 130 that may be coupled anywhere along a top or side of base pad 101. Track 130 is a semi-rigid rod that may function similar to the rod 107*a* in supporting one or more clips 350 as described in greater detail hereinafter with reference to FIGS. 3C and 3D. As further illustrated in FIG. 1C, track 130 comprises a semi-rigid rod that is coupled to base pad 101 by a fabric sleeve 132. More specifically, sleeve 132 may comprise a fabric strip that has its lengthwise ends sewn into a seam 133 in base pad 101 to form a tube. Seam 133 is the seam that is formed when connecting portions 101*a* and 101*b*. The rod is slid through sleeve 132 and then the ends 136 and 138 of sleeve 134 are sewn down and incorporated into the seam. Prior to sewing the ends into the seam, clip 350 is inserted over the fabric sleeve. In the way, clip 350 will not detach from track 130. As another option, the ends of the rod may be held in pockets to secure the rod to base pad 101. In this way, a fabric sleeve would not be needed.

One or more toys 126 may be coupled to clip 350 in a manner similar to that described in connection with other embodiments. This allows items, such as toys to be removably coupled with base pad 101. Further, the location of the items can easily be adjusted by sliding them along track 130 using clip 350. For example, a toy can be moved to a mid portion of base pad 101 to provide easy access to the toy by the child. However, when the child needs to be removed from base pad 101, clip 350 may be slid to one side to move the toy. As another example, clip 350 may be slid along track 130 to place the toy in a different location to thereby provide a different environment within the play structure.

The fabric used to form fabric sleeve 132 should be durable because of friction caused by the slider clip when moving over the rod. The fabric should be sufficiently durable so that the rod will not break through the fabric over time. Preferable fabrics include nylon fabrics. An especially good fabric is a denier nylon with or without a polyurethane coating.

Figure 1B:
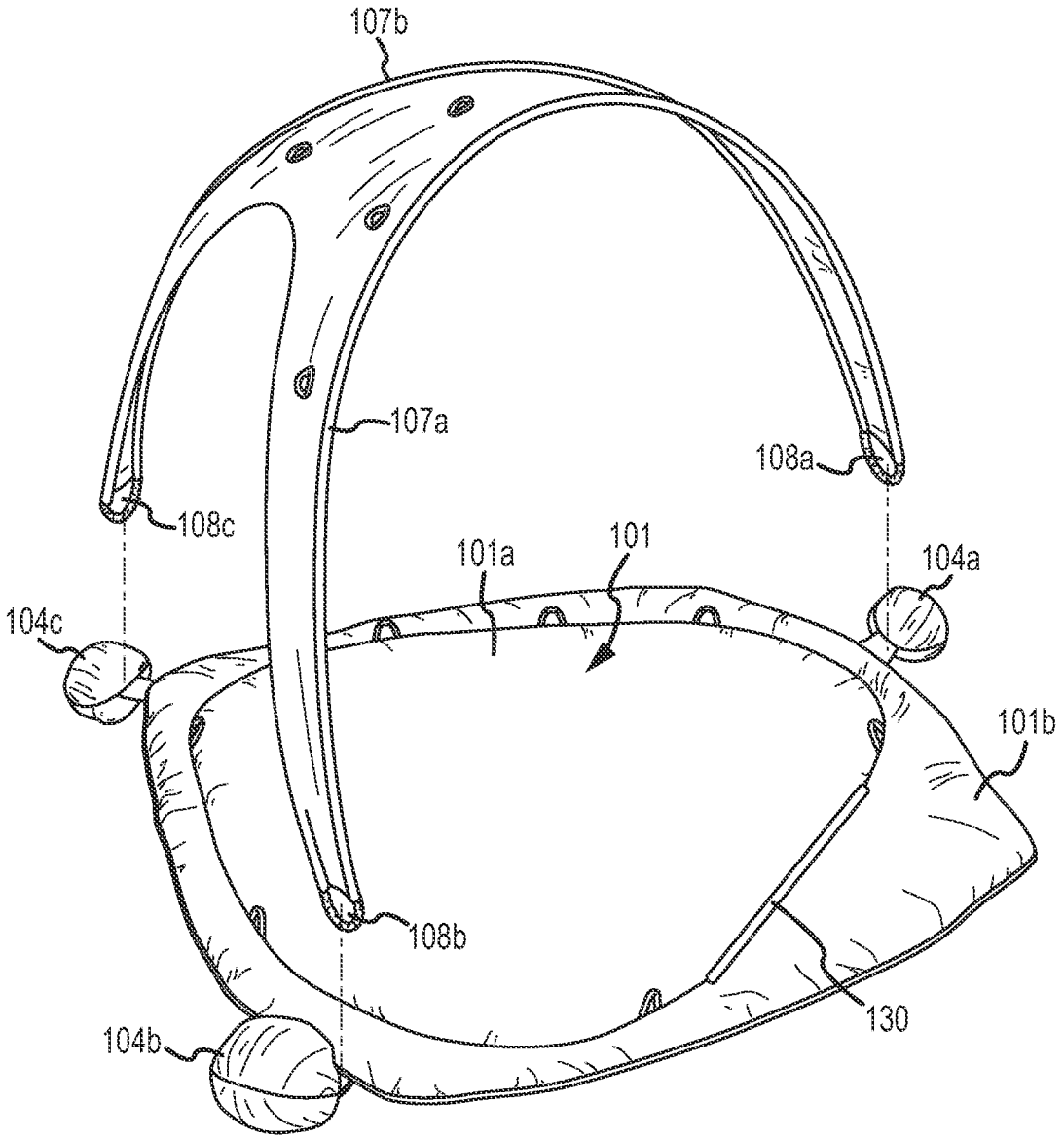
FIG. 1B shows the play gym of FIG. 1 with some of its parts separated, in accordance with embodiments of the invention.
Figure 1C:
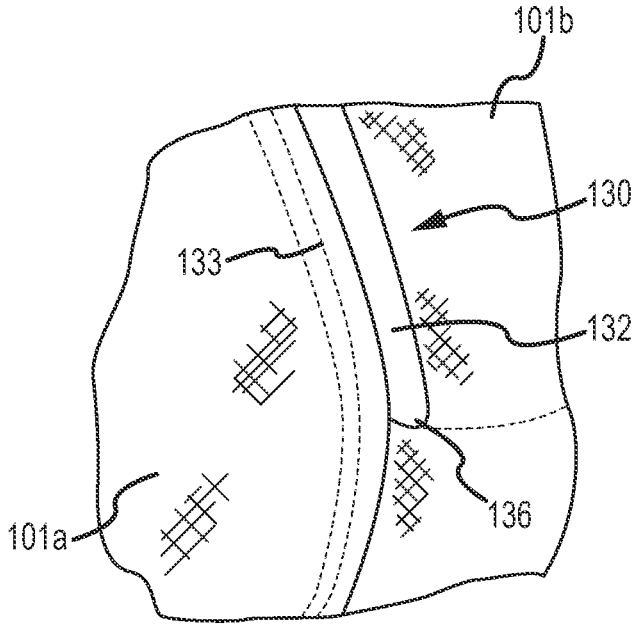
FIG. 1C is a magnified view of one end of a track of the play gym of FIG. 1A.

FIG. 1B shows canopy 102 separated from the rest of play gym 100. Canopy attachment loops 108*a-c* are placed at the lower ends of legs 105*a-c*. Loops 108*a-c* are configured to engage the attachment members 104*a-c* to attach canopy 102 to base pad 101. To make the attachment, each attachment member is passed through its respective loop. If attachment members 104*a-c* are compressible, each attachment member may be compressed to pass through its corresponding loop and then allowed to re-expand. Canopy attachment loops 108*a-c* may also be stretchable, so that when the loops are unstretched, the loops are smaller than the attachment members. This arrangement may help ensure a secure attachment of canopy 102 to base pad 101, but also allow for easy disassembly of play gym 100. As another option, loops 108*a-c* may each comprise two straps with ends having a hook and loop fastener material. In this way, the two straps may be wrapped about the attachment members 104*a-c* and then secured to each other about their respective ends.

Play gym 100 may comprise one or more openings for attaching items 103 to play gym 100. For example, surface sheet 106 may include spaced apart holes 109, which may be reinforced by stitching around the perimeter of the hole or by other means. In another example, base pad 101 or canopy 102 may include loops such as item attachment loops 110 shown in FIG. 1. These holes and loops may be used to attach various toys, such as, for example, the toy in FIG. 2. However, the holes and loops can also be used with traditional toy links, also referred to as "C" clips or "C" links, to which various items may be attached.

Figure 2:
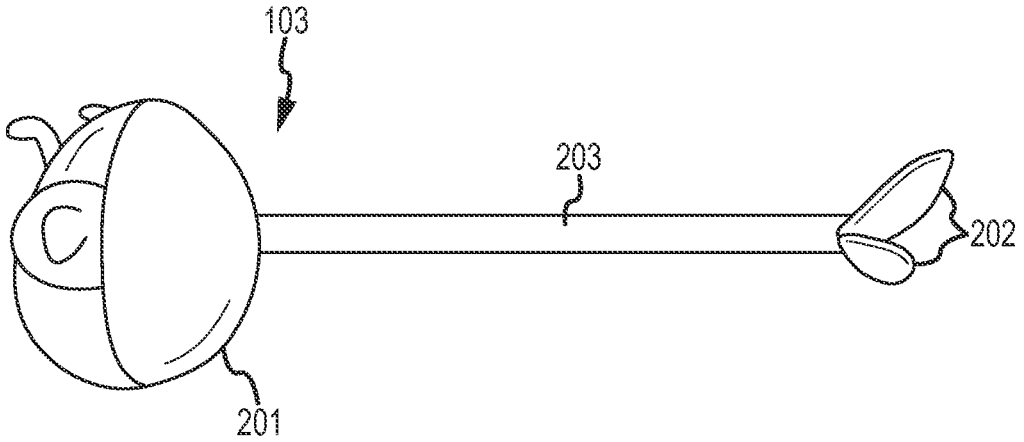
FIG. 2 shows an example item that may be attached to the play gym of FIG. 1.

FIG. 2 shows an example item 103 that may be attached to play gym 100. In this example, item 103 is a ball configured to attach to play gym 100, but many different kinds of items may be configured to attach to play gym 100, including such items as a toy, a block, a pyramid or other geometric shape, a doll, a teething ring, an item comprising a mirror, a toy shaped like an animal or insect, a toy shaped like a plant or flower, or another suitable item. Preferably, items attached to play gym 100 are selected to be entertaining and stimulating to an infant placed in play gym 100.

As is shown in FIG. 2, item 103 includes a main body 201 and a compressible member 202 connected to the main body 201. In this example, compressible member 202 is connected through tether 203, but other connection arrangements may be used. Compressible member 202 may have any suitable shape, such as a ball shape, a block shape, a pyramid shape or other geometric shape, a button shape, a leaf or flower shape, an animal shape, a shape reminiscent of wings, or another shape. The shapes may or may not incorporate sound, light or vibration features. Compressible member 202 is preferably somewhat larger in its uncompressed state than holes 109 or item attachment loops 110. Item 103 may then be attached to play gym 100 by squeezing compressible member 202 through one of holes 109 or item attachment loops 110 and allowing compressible member 202 to re-expand, providing a secure but easily removable connection. This attachment system has the additional advantage that the materials involved may be soft and pliable and all of the parts may be relatively large, resulting in a safe environment for the infant.

Figure 3A:
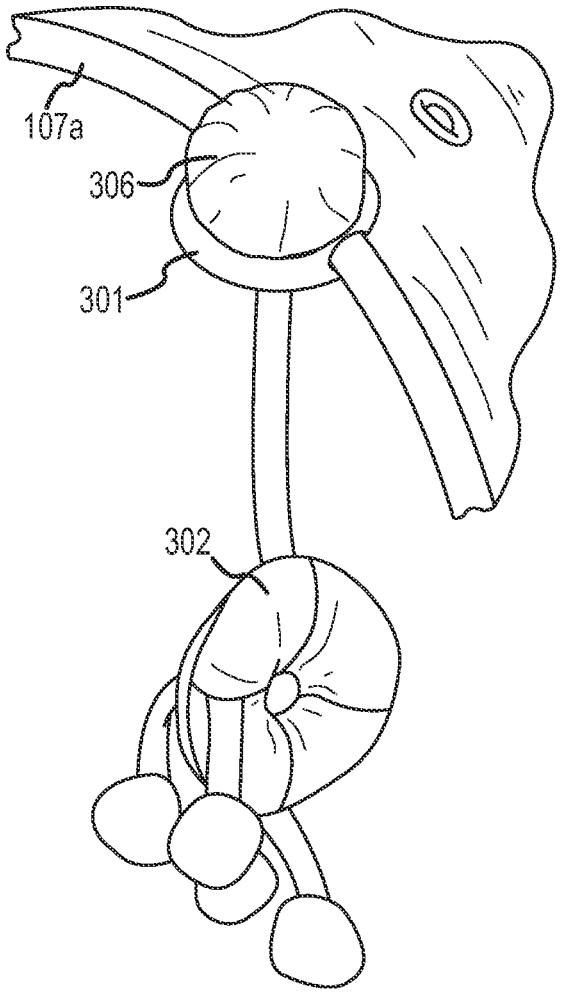
FIG. 3A illustrates an attachment of an item in accordance with another embodiment.

FIG. 3*a* illustrates another embodiment of an attachment of an item 302 to play gym 100. In this embodiment, clip 301 is slidingly engaged with rod 107*a*. One or more clips such as clip 301 may be engaged with any or all rods of canopy 102. Preferably, rod 107*a* is embedded in play gym 100 so that it is accessible for engagement with clip 301. For example, rod 107*a* may be embedded by wrapping rod 107*a* in a portion of surface sheet 106. In that configuration, rod 107*a* may be thought of as residing in a tubular pocket sewn into surface sheet 106. Not all of the rod need be wrapped or embedded. Even if part of a rod is wrapped, some of the rod may be left exposed. In some embodiments, the portion of surface sheet 106 wrapping rod 107*a* may be made of a woven nylon or other durable fabric, to provide a suitable amount of friction to clip 301, and to resist wear.

Figure 3B:
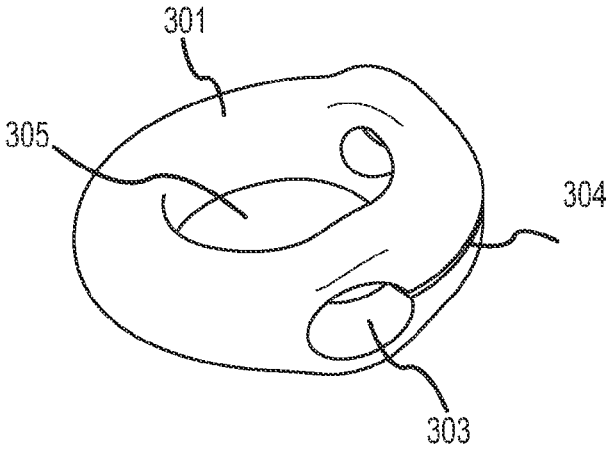
FIG. 3B illustrates a clip in accordance with embodiments of the invention.

FIG. 3*b* illustrates clip 301 in isolation. Clip 301 is generally toroidal, but need not be perfectly toroidal. A slotted passage 303 is provided at one side of clip 301. Slotted passage 303 is configured to slidingly engage a rod such as rod 107*a*. The rod and slotted passage may be any size, so long as passage 303 is sized so that clip 301 is easily slid along the rod, but will maintain its position on the rod when left at rest. This kind of sliding fit may be facilitated by the natural compliance of a portion of surface sheet 106 that may be wrapped around the rod, and by the split configuration of passage 303. Clip 301 is preferably substantially rigid so that it is not reasonably removable from the rod without sliding clip 301 past an end of the rod.

Once clip 301 is engaged with rod 107*a* (or another rod) the fabric or other material wrapping rod 107*a* may engage with slot 304 of passage 303, and limit the rotation of clip 301 around rod 107*a*. Hole 305 in clip 301 provides an opening configured for attaching items to play gym 100. For example, compressible member 306 of item 302 may be passed through hole 305 to hang item 302 from canopy 102. Multiple clips 301 may be provided on play gym 100, and one or more clips may be provided on any or all semi-rigid rods used to support a canopy. Any or all clips 301 mounted on canopy 102 may be easily moved to adjust the positions of items such as item 302 attached to canopy 102 using clips 301.

It will be appreciated that many variations are possible in the configurations of the items to be attached to a piece of child care equipment such as play gym 100.

For example, referring again to FIG. 1, item 111 may comprise a mirror surface (which may be surrounded by suitable padding) to allow the child to see a reflection of himself or herself. Item 111 also illustrates another variation. Item 111 includes two compressible members 112 and 113, which are passed through two of item attachment loops 110, to further constrain the position of item 111. In another example, item 302 shown in FIG. 3A has a main body in the shape of an animal. Other items may have main bodies shaped like insects, plants, flowers, geometric shapes, or other objects that may entertain or stimulate the child.

In some embodiments, an item attached to a piece of child care equipment may generate sound. For example, a ball or other item may be filled with a material that makes a crackling sound when the ball is squeezed, encouraging the child to interact with the item. An attached item could include an electronic sound generating device that plays music, animal sounds, tells a story, or generates some other kind of sound when the item is squeezed, caused to move, or otherwise activated. In addition, an item may also incorporate a light feature or a vibration feature which can be activated by movement or a switch, also encouraging the child to interact with the item.

Figure 3C:
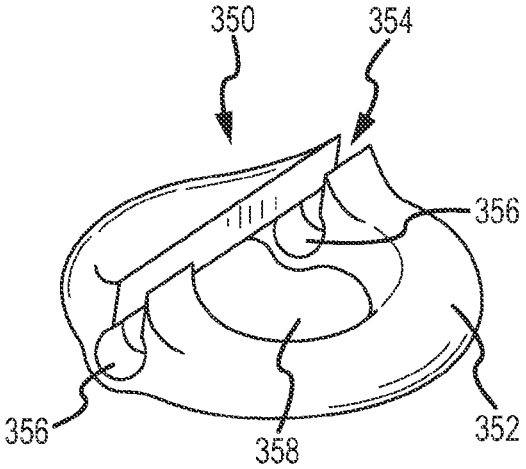
FIG. 3C is a bottom perspective view of an alternative clip according to the invention.
Figure 3D:
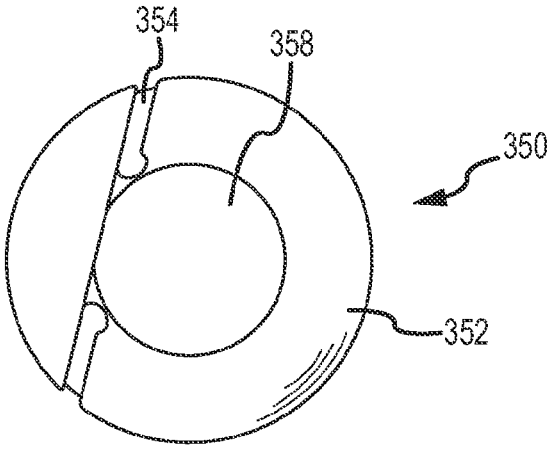
FIG. 3D is a bottom plan view of the clip of FIG. 3C.

FIGS. 3C and 3D illustrate clip 350 of FIG. 1A in greater detail. Clip 350 comprises a clip body 352 that is generally toroidal in geometry. Clip body 352 has a slot 354 leading to a passage 356 through which the rod will slide. Slot 354 is wide enough to prevent the fabric sleeve to slide through it. Passage 356 is sized to be just large enough so that it can smoothly slide over the rod and fabric sleeve. If passage 356 is too large, clip 350 will be too loose and will not easily slide, and may be able to separate from the rod. Conversely, if it is too small, then it will bind against the sleeve and/or rod making movement difficult. Thus, the rod should be small enough that it can be wrapped in the nylon fabric forming the sleeve and still have the clip slide, but not so small that the clip snaps off the rod and presents a safety hazard. The passage in clip 301 may be sized in a similar manner. Clip 350 also defines a central opening 358 where a compressible member of a toy may be placed similar to other embodiments described herein.

Another feature of clip 350 is that slot 354 is generally perpendicular to the clip body, while with clip 301 the slot 304 is parallel to the clip body. This permits clip 350 to be generally parallel to the base 101 as illustrated in FIG. 1A so that it does not stick up and interfere with the baby's play. With clip 301, the clip body is generally aligned with the fabric on the arched support. While the clip body does extend from the rod, this does not interfere with the baby's play and also allows the toy to more easily hang from the arched support. In some cases, clips may be constructed where the slot is at different angles relative to the clip body, such as 15 degrees, 30 degrees, 45 degrees, 60 degrees and the like, to permit the clip body to be at different angles relative to the adjacent fabric or base layer.

Many variations are also possible in the shapes of the compressible members used to attach items to the child care equipment. For example, compressible member 202 shown in FIG. 2 may be reminiscent of leaves, animal ears, or wings. Compressible member 306 shown in FIG. 3A is in a simple ball shape. Other possible shapes include a flattened ball or button shape, other geometric shapes, leaf and flower shapes or animal shapes.

Figure 4:
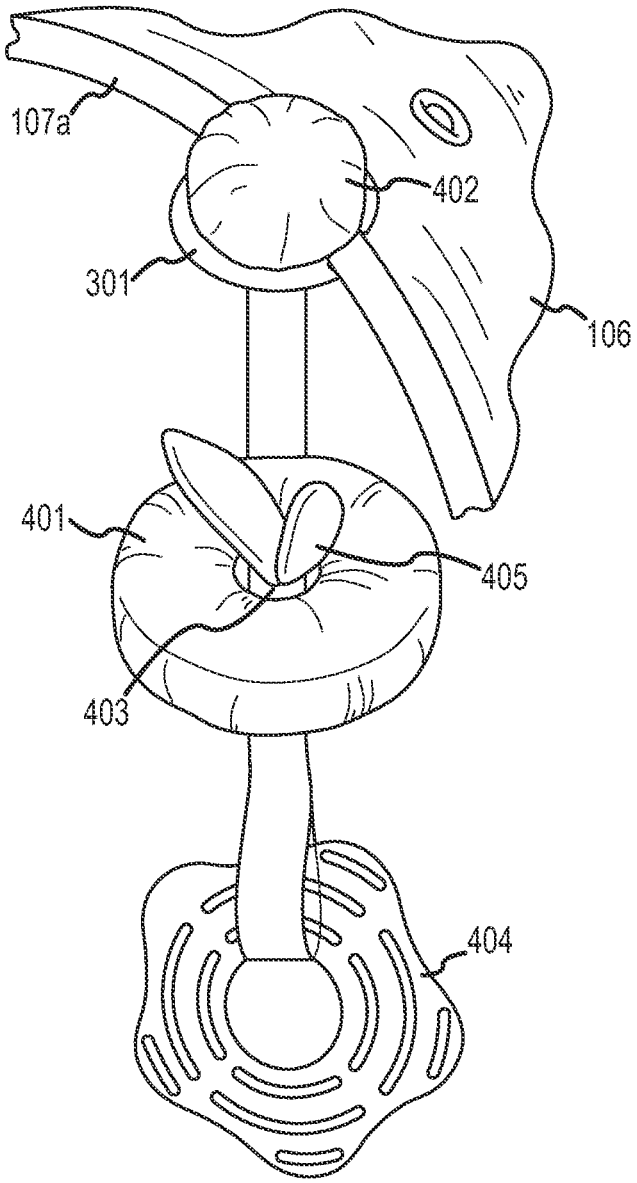
FIG. 4 shows an item attachment in accordance with another example embodiment.

FIG. 4 shows another example item 401 attached through a clip 301 engaged with rod 107*a*. In this example, item 401 includes a button-shaped compressible member 402 engaged with clip 301. The main body of item 401 is generally toroidal or donut shaped having an opening 403. A second item 404 is suspended from opening 403 in item 401. In this example, second item 404 includes a teething ring, and also includes a compressible member 405 in a shape reminiscent of leaves.

Attachment systems and methods according to embodiments of the invention may be used with a variety of child care equipment. Play gym 100 shown in FIG. 1A is but one example. Other kinds of equipment that may embody the invention include, without limitation, a play yard, a playpen, a swing, a baby bouncer, a shopping cart liner, a stroller, a car seat, a booster seat, a high chair, a play pad, a changing pad and a changing pad cover.

Figure 5:
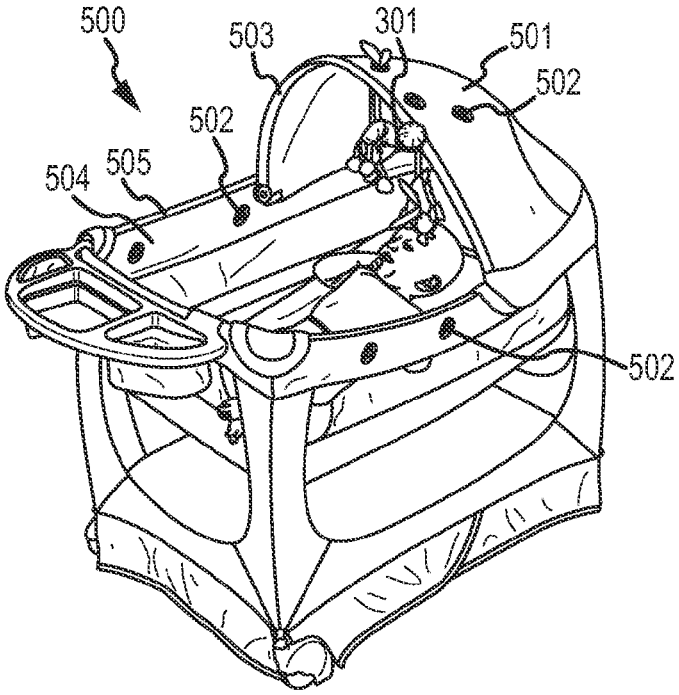
FIG. 5 shows a play yard in accordance with embodiments of the invention.

In one example, FIG. 5 shows a play yard 500 in accordance with embodiments of the invention. A play yard is a device similar to a traditional playpen, and is designed to provide a safe and constrained space for a child to spend time. A play yard may be placed, for example, in a corner of a room, or even outdoors when it is desired that the child accompany a group on a picnic or other outing. Play yard 500 includes features for attaching toys or other items. For example, play yard 500 includes a dome 501, which may include holes 502 for attaching items as previously described. An edge of dome 501 may include an embedded semi-rigid rod 503 and a clip 301 slidingly engaged with rod 503 for attaching items. Other portions of play yard 500 may also include openings or rods. For example, a wall or side 504 of play yard 500 may include holes 502, an embedded semi-rigid rod 505, or both; or the bottom of the play yard may include an embedded semi-rigid rod. Other examples of play yards or other play structures that may include such attachment systems are described in U.S. Pat. No. 7,290,303, and Published U.S. Application No. 2007/0271703 and 2002/0042953, incorporated herein by reference.

Figure 6:
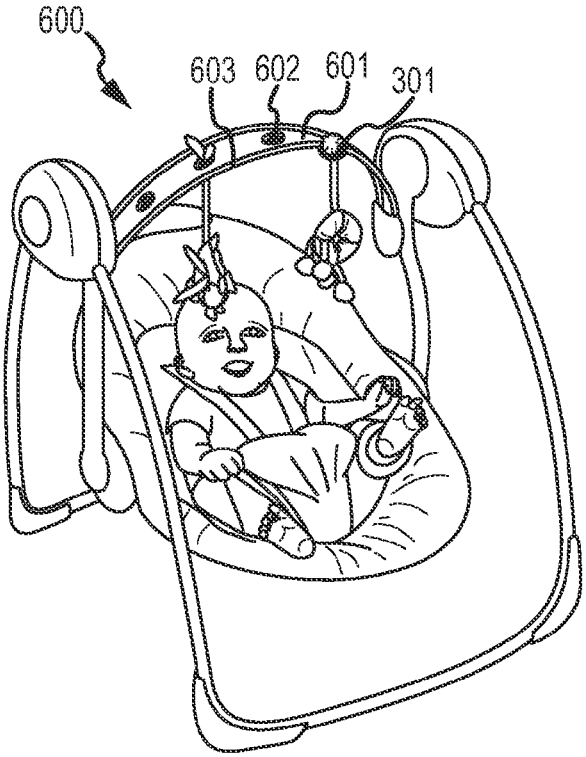
FIG. 6 shows a swing in accordance with embodiments of the invention.

In another example, FIG. 6 shows a swing 600 in accordance with embodiments of the invention. Example swing 600 includes an arched support frame 601 that includes holes 602 in a surface sheet and an embedded semi-rigid rod 603 for attaching items, for example using clip 301. Swing 600 may be used, for example, to provide a place for a baby to relax, with the swinging motion providing a comfort and enjoyment for the baby. The items suspended from arched support frame 601 provide additional entertainment and stimulation.

Figure 7:
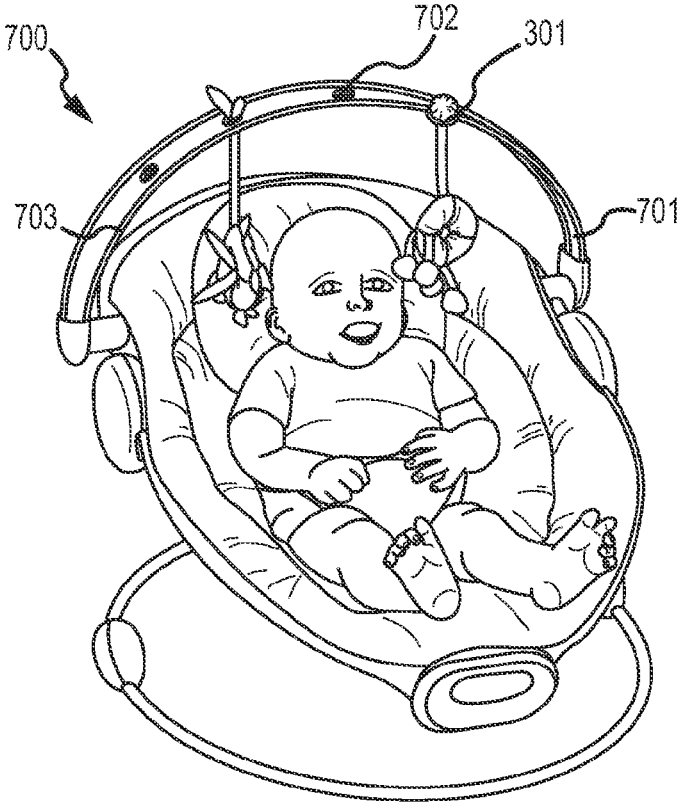
FIG. 7 shows a bouncer in accordance with embodiments of the invention.

FIG. 7 shows a bouncer 700 in accordance with embodiments of the invention. A bouncer is a device used in a manner similar to a swing, but provides a bouncing motion rather than a swinging motion. Bouncer 700 also includes an arched support frame 701 having holes 702 in a surface sheet and an embedded semi-rigid rod 703, for mounting items using a clip 301.

Figure 8:
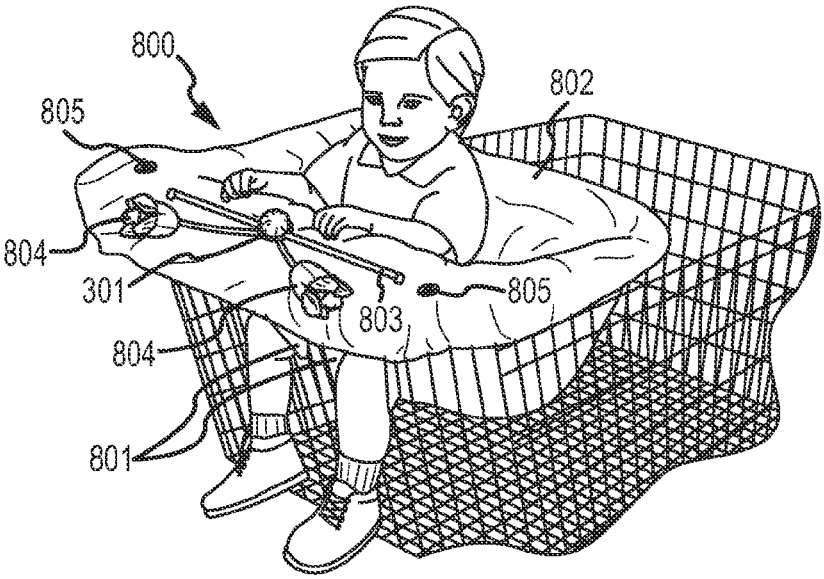
FIG. 8 shows a shopping cart liner in accordance with embodiments of the invention.
Figure 8A:
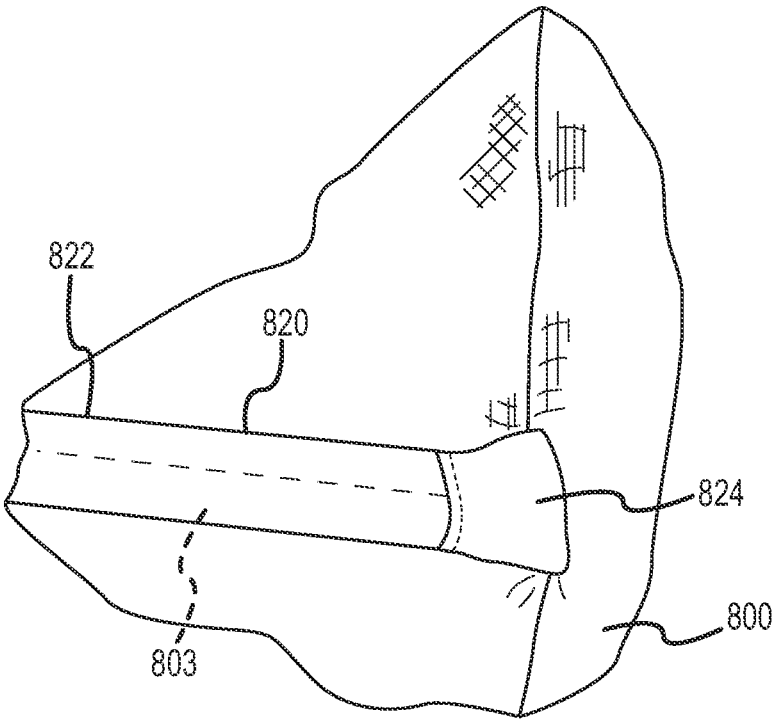
FIG. 8A is a magnified view of one end of a track of the cart liner of FIG. 8.

FIG. 8 shows a shopping cart liner 800 in accordance with embodiments of the invention. Shopping cart liner 800 is configured to nest in the child seat portion of a shopping cart to provide a clean liner over unsanitary surfaces. Liner 800 also provides protective soft surfaces for a child to encounter, rather than the hard, cold materials of which the shopping cart itself is usually made. Similar liners may be constructed for strollers, child car seats, high chairs, booster chairs, or other items in which a child may be placed, and one of skill in the art will recognize that the attachment features of shopping cart liner 800 may be adapted to other kinds of liners as well. Shopping cart liner 800 includes leg holes 801 and a padded shell 802. A rod 803 is embedded in a portion of shopping cart liner 800 that a child faces when the liner is in use. As in other embodiments, rod 803 may be embedded by wrapping it in a fabric sleeve 820 or other sheet sewn into shopping cart liner 800, or may be embedded in some other way. As illustrated in FIG. 8A, fabric sleeve 820 is sewn into a seam 822 of liner 800 such that it forms a tube into which rod 803 may be inserted. After inserting rod 803 into the sleeve, each end 824 of the sleeve is folded back and then sewn onto itself as well as to the liner 800 as illustrated in FIG. 8A. Alternatively, an additional piece of fabric can be sewn over the ends and to the liner to insure that the ends of rod 803 will not poke through the sleeve. A clip 301 is slidingly engaged with rod 803, and toys or other items 804 are attached to shopping car liner using compressible members passed through the hole in clip 301. Typically, slider clip 301 is inserted over rod 803 and sleeve 820 prior to sewing ends 824 back on themselves to insure that clip 301 will remain attached to rod 803. In this example, both items 804 are shaped like flowers, and both are attached through the same opening in clip 301. Shopping cart liner 800 may also have holes 805 through which other items may be attached using the methods described above. When attached to shopping cart liner 800, items 804 provide entertainment and stimulation to a child riding in the shopping cart, and because they are attached, are not likely to be dropped or lost.

Figure 9:
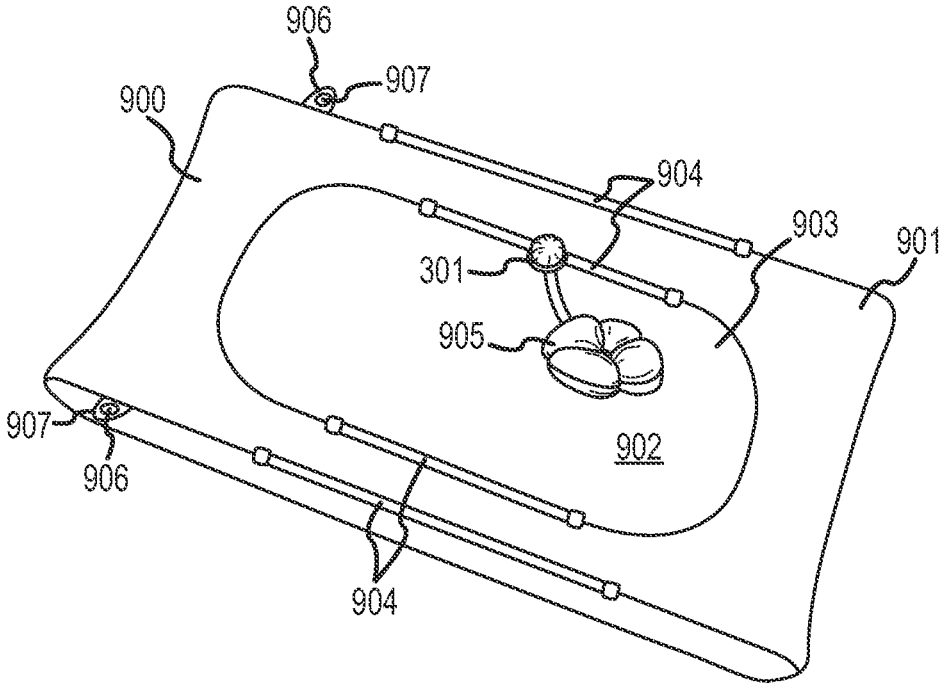
FIG. 9 shows a changing pad in accordance with embodiments of the invention.

FIG. 9 shows a changing pad 900 in accordance with embodiments of the invention. A changing pad is a soft pad of a convenient size and shape for holding an infant while its diaper is changed. Example changing pad 900 includes a cover 901 stretched over the outer surface of pad 900 in a manner similar to a fitted sheet over a mattress. Optionally, a protective liner 902 may be placed on top of cover 901. This may be constructed of a waterproof material to protect pad 900. Changing pad 900 also includes features for attaching items in accordance with the systems and methods described above. For example, one or more rods 904 may be embedded in various seams of cover 901, either at interior seams around opening 903 or at outer edges of changing pad 900. Rods 904 may encompass only a portion of a particular seam, as is shown in FIG. 9, or may encompass all of one or more seam. Rods similar to rods 904 may be embedded in other ways in changing pad 900 as well. Preferably, at least one clip 301 is slidingly engaged with each embedded rod. (Only one clip 301 is shown in FIG. 9 for clarity.) Items such as item 905 may be attached through the holes of any or all of the clips, as described previously. Changing pad 900 may also include tabs 906 protruding from cover 901 and having holes 907, providing additional or alternative attachment sites. Other kinds of pads, for example play pads, may be used in child care, and one of skill in the art will recognize that attachment features described above in relation to changing pad 900 may be adapted for use in other kinds of pads as well.

In some embodiments, an arch or an arm may be suspended over the changing pad in a manner similar to the play yards, swings and bouncers described herein. This arch or arm may include a flexible semi-rigid rod as in other embodiments to which a slider clip may be attached. In this manner, various items may be suspended over the changing pad. It could also include holes or loops through which the toys described herein may be attached.

The slider clips, rods, tracks, as well as the openings and loops for receiving compressible toys that are described herein may be incorporated into a variety of other products, such as on a crescent shaped pillow, including those described in U.S. Pat. Nos. 5,261,134, 5,661,861; 6,038,720; 6,055,687; 6,685,024; 6,434,770; 6,671,908; 7,017,212; 6,279,185; 6,412,128; 7,451,508; 7,127,760; 6,944,898; 7,587,773; 7,472,443; and 7,404,222, incorporated herein by reference, and on slipcovers, including the slipcovers described in U.S. Pat. Nos. 6,453,493; 6,625,828; 6,851,143; 7,000,274; and 7,146,663, incorporated herein by reference. As another example, the attachment systems described herein may be used to attach items such as a pacifier, a pocket (such as to hold a cell phone or bottle), or the like to a large piece of equipment. As further examples, the attachment systems described herein may be used in connection with other equipment such as a walker, a jumper (that hangs in a doorway with elastic straps hooked onto a seat so baby can jump up and down), a pram or stroller, a baby exerciser or rocking saucer (like those sold by Evenflo and ExerSaucer), a baby activity center (such as those similar to the ExerSaucer, but without the saucer-shaped bottom), a toddler chair, a bassinet or crib, a crib mobile (having the slider system and/or holes in the mobile canopy), a crib bumper, a car seat organizer (such as a pocket organizer which fits over the back of the front seat), a storage basket, a storage bin or toy chest, a diaper bag, a baby carrier, including front or back baby carriers, a baby sling, an infant bath tub, a bath tub infant seat or a bath tub accessory with a suction cup, a baby bib, a book for baby (where the slider clip may be incorporated into the spine of the book or across the cover), a rocking chair, a glider chair, or the like.

Figure 10:
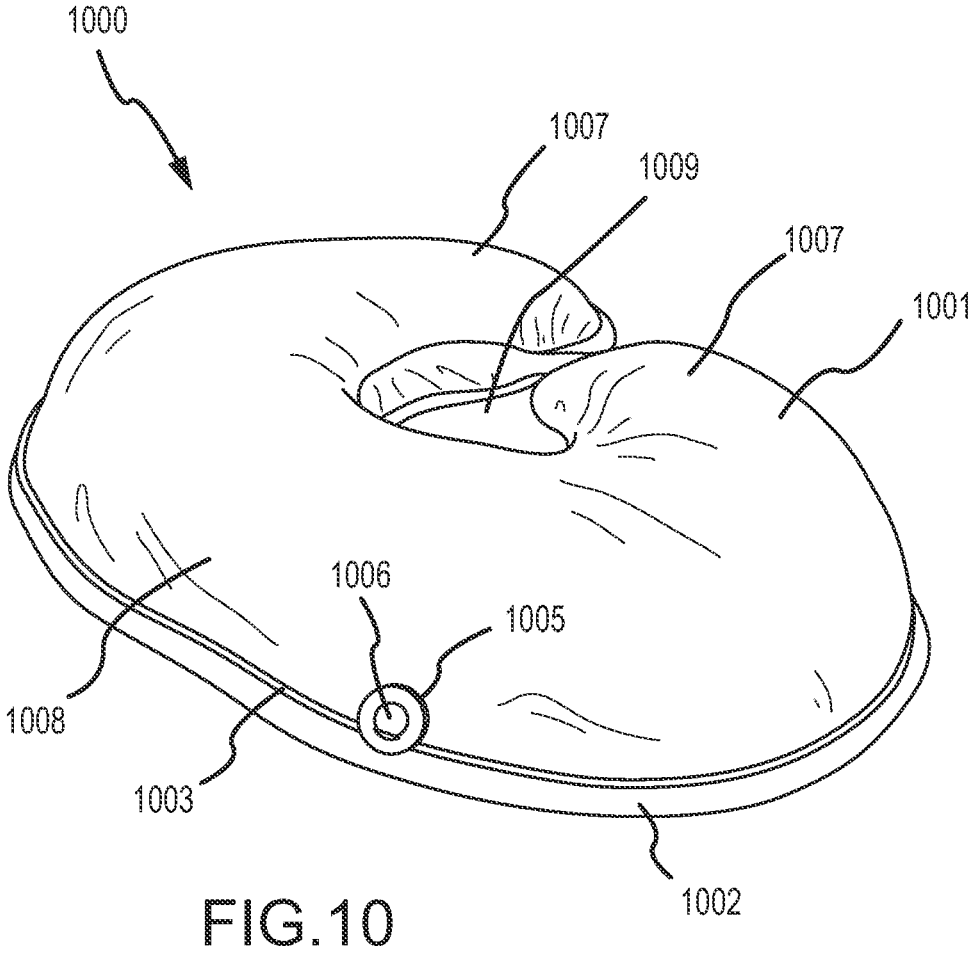
FIG. 10 illustrates a pillow in accordance with embodiments of the invention.

FIG. 10 illustrates a pillow 1000 in accordance with embodiments of the invention. Pillow 1000 may include a compressible fill material enclosed by a flexible shell 1001. The fill material may be selected to be resilient and durable, and may be hypoallergenic. Examples of fill materials that may be used in embodiments of the invention include polyester fibers, or foam materials, although other materials may be used. Flexible shell 1001 may be a fabric shell, but could also be a synthetic shell such as a shell made of a plastic sheet, or could be made of another suitable material. The material of flexible shell 1001 may be selected to be comfortable and durable, and may be selected to be easy to clean. Examples of shell materials that may be suitable for use in embodiments of the invention include cotton, nylon, LYCRA, denim, polyester, microfibers, and the like. Pillow 1000 may be conveniently constructed by sewing together two pieces of fabric along a center seam 1002 and filling the resulting structure.

Pillow 1000 also includes a track 1003 at least partially embedded in the flexible shell 1001. For example, track 1003 may be a semi-rigid rod having a substantially circular cross section, and may be embedded by wrapping a portion of flexible shell 1001 around track 1003 during construction of pillow 1000. Alternatively, track 1003 may wrapped by a fabric sleeve of material that is in turn sewn into flexible shell 1001, or may be embedded by some other method. Parts of track 1003 may be left exposed, or track 1003 may be completely embedded. Track 1003 may be embedded and held in place by the technique described above and shown in FIG. 8A, or may be held in place by some other suitable arrangement.

In other embodiments, track 1003 may be made of foam welt material. Foam welt is an elongate flexible material, often circular in cross section, and is available from National Bias Binding Corp. of 140 58$^{th}$ Street 2L, Brooklyn, N.Y. 11220, among other suppliers. One advantage of using foam welt to form track 1003 is that it is machine washable. Being substantially flexible, it may also be configurable into complex curves and other shapes, and may permit the item in which it is embedded to be folded, rolled, or otherwise reduced in size for packing or storage. It may be possible to sew directly across a track made of foam welt, and when a track made of foam welt is embedded in a seam of a product, the ends of the track may be captured by simply turning the track through the seam and sewing across the track. This technique is explained in more detail below.

Figure 10A:
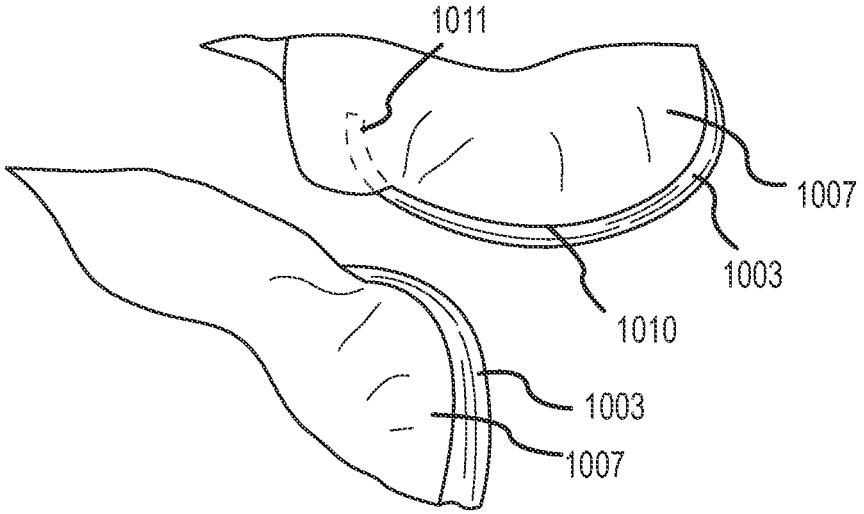
FIG. 10A illustrates a treatment for the ends of track, in accordance with embodiments of the invention.

While pillows of a variety of shapes may be used in accordance with embodiments of the invention, exemplary pillow 1000 is generally arc shaped, having two curved arms 1007 extending from a midsection 1008, to define an open well 1009. Track 1003 may not extend to the entire perimeter of pillow 1000, but may cover only the outer perimeter of pillow 1000 and the ends of arms 1007, or some other incomplete portion of the perimeter of pillow 1000. FIG. 10A illustrates a treatment for the ends of track 1003. Preferably, the ends of track 1003, such as end 1011 shown in FIG. 10A, are disposed within shell 1001, so that the ends are well protected. For example, the track ends and a casing fabric or other material in which track 1003 is wrapped may be extended through seam 1010 to the inside of pillow 1000. The casing or wrapping material may be over sewn to prevent track 1003 from shifting longitudinally within the casing or wrapping material. This technique is described in more detail below. The casing or wrapping material could also extend somewhat beyond the ends of track 1003, and be sewn shut to constrain track 1003, and could also be folded over the ends of track 1003 for further security. Similarly, portions of shell 1001 in the vicinity of the track ends may be strengthened with additional stitching.

Pillow 1000 further includes a clip 1005, which may be similar to clip 301 or to clip 350. Clip 1005 may include a slotted passage configured to slidingly engage track 1003, to enable clip 1005 to be positioned at different places along the track. While only one clip 1005 is illustrated, it is to be understood that multiple similar clips could be engaged with track 1003.

Figure 11:
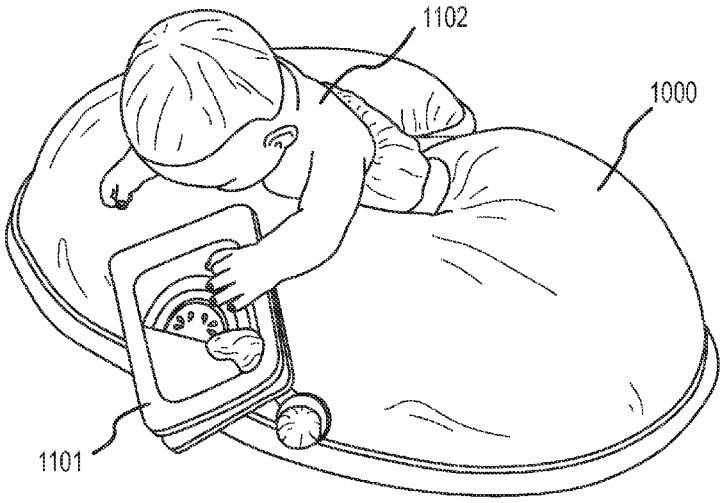
FIG. 11 illustrates the pillow of FIG. 10 with a toy attached, in accordance with embodiments of the invention.

Clip 1005 defines an opening 1006 for attaching one or more items to pillow 1000, for example, a toy or other child-care item may be attached. FIG. 11 illustrates that a toy 1101 has been attached to pillow 1000 and positioned to be accessible to a child 1002 using pillow 1000 as a resting place. Pillow 1000 may be used in other ways as well. For example, the arced shape of pillow 1000 may be especially useful for supporting a baby on its mother's lap while nursing, and items useful in the nursing environment could be adapted with compressible members and attached to pillow 1000 via clip 1005. Examples of items that might be useful in a nursing environment include a burp cloth, a wash cloth, toys for the entertainment of the child, a removable pocket for a cellular telephone, or other items.

Figure 12:
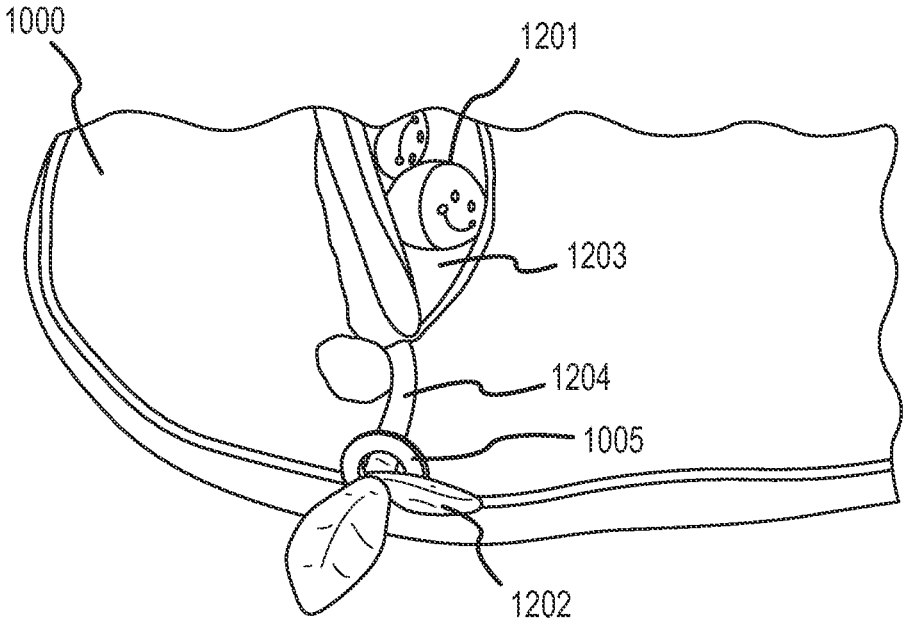
FIG. 12 illustrates the attachment of a toy to the pillow of FIG. 10 via a clip, in accordance with embodiments of the invention.

FIG. 12 illustrates another toy 1201 attached to pillow 1000 via clip 1005. In this example, a compressible member 1202, having a shape reminiscent of leaves or wings, has been compressed and passed through opening 1006, and then allowed to re-expand. Compressible member 1202 is attached to a main portion 1203 of toy 1201 by a tether 1204. Once compressible member 1202 has been passed through clip 1005, toy 1201 is attached to pillow 1000. Toy 1202 can be removed from pillow 1000 by compressing compressible member 1202 and withdrawing it from clip 1005.

Figure 13:
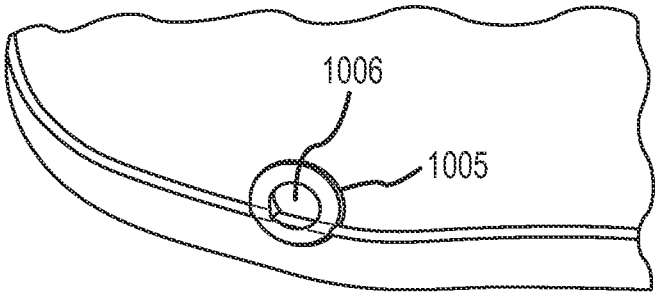
FIG. 13 illustrates the clip of FIG. 12 in greater detail.

FIG. 13 shows clip 1005 in greater detail where it engages pillow 1000. A clip configured similarly to clip 350 may be especially suitable for use with pillow 1000. A clip having a slot that is generally perpendicular to the clip body enables clip 1005 to lie generally flat against the body of pillow 1000, so that clip 1000 does not protrude more than necessary from pillow 1000. The generally flexible materials used to make pillow 1000 enable access to opening 1006 for attachment and detachment of toys or other items.

Figure 14:
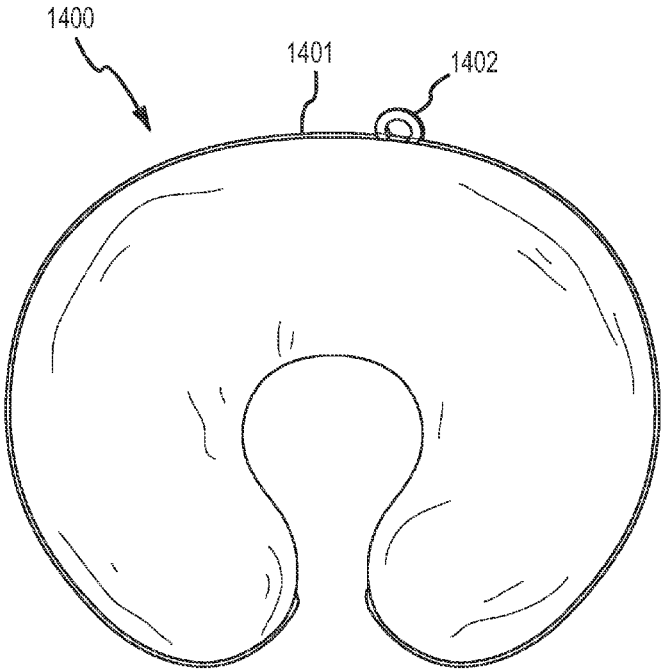
FIG. 14 shows a slipcover in accordance with embodiments of the invention.

FIG. 14 shows a slipcover 1400 in accordance with other embodiments. Slipcover 1400 includes a flexible shell configured to conform to an outer shape of a particular pillow, for example a pillow having the general shape of pillow 1000. Slipcover 1400 may be made of any suitable material, for example materials of which shell 1001 of pillow 1000 may be made. Slipcover 1400 includes a track 1401 at least partially embedded in slipcover 1400, and a clip 1402 slidingly engaged with track 1401. Slipcover 1400 is preferably openable, for example using a zipper, so that slipcover 1400 can be snugly fitted over a pillow. Slipcovers are often used in this way to provide additional protection to a pillow, and so that the slipcover can be removed and cleaned. Slipcover 1400 has the additional advantage that it includes track 1401 and clip 1402, so that once slipcover 1400 is placed over a pillow, items may be attached to the pillow using clip 1402, in a way similar to the techniques previously described. In this way, slipcover 1400 may be used to retrofit an attachment system to an existing pillow.

Figure 15:
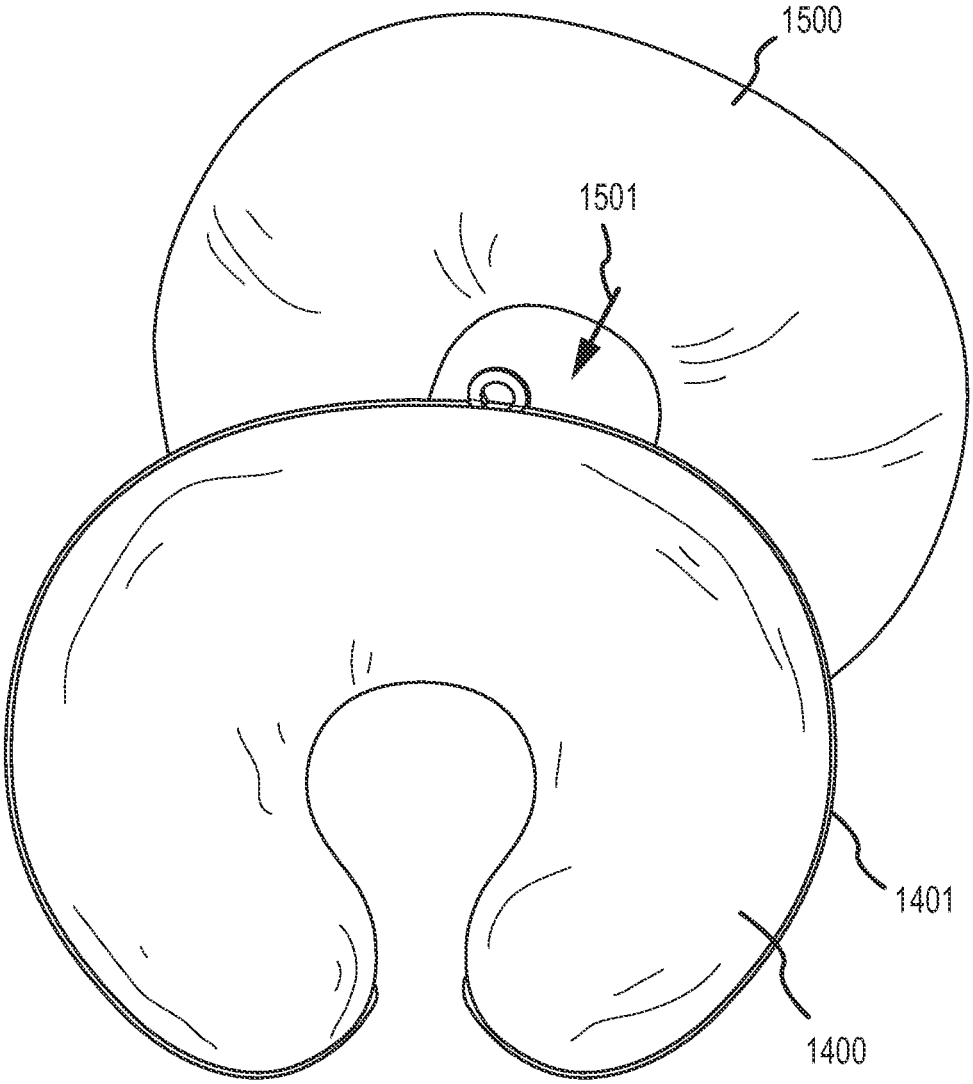
FIG. 15 shows a pillow engaging with the slipcover of FIG. 14.

For example, FIG. 15 shows a pillow 1500 in the process of engaging with slipcover 1400, in accordance with other embodiments, by being inserted into slipcover 1400 in the direction shown by arrow 1501. Example pillow 1500 is similar to pillow 1000 shown in FIG. 10, but lacks a track or clip for attaching items. Once slipcover 1400 is secured on pillow 1500, pillow 1500 may be better protected and also includes an attachment system for attaching items to pillow 1500. While pillow 1500 has a shape similar to pillow 1000, a slipcover in accordance with embodiments of the invention may be configured to cover a pillow of any suitable shape.

Figure 16A:
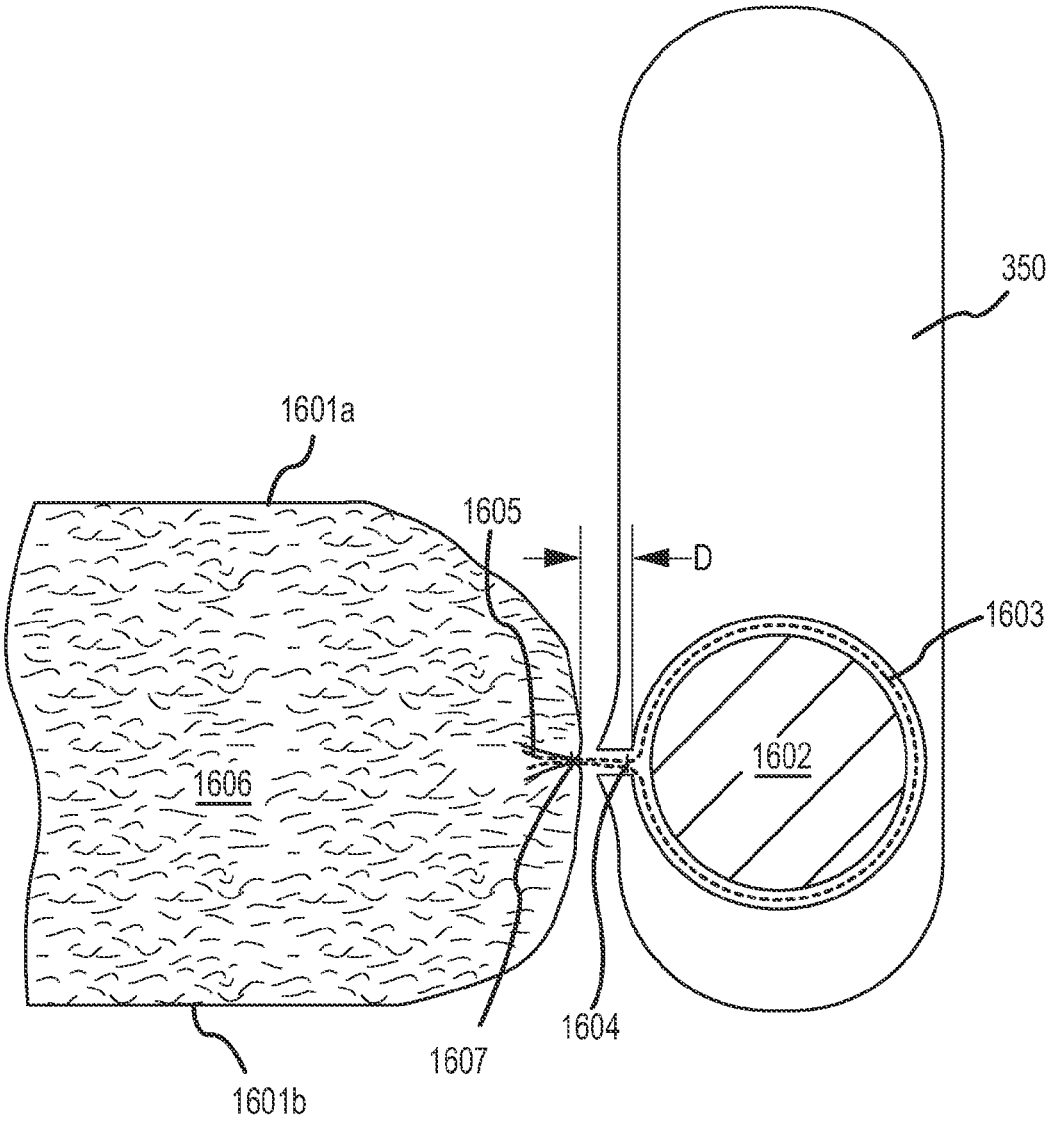
FIGS. 16A-16C illustrate embodiments of attaching a track at a seam of a piece of child care equipment.
Figure 16B:
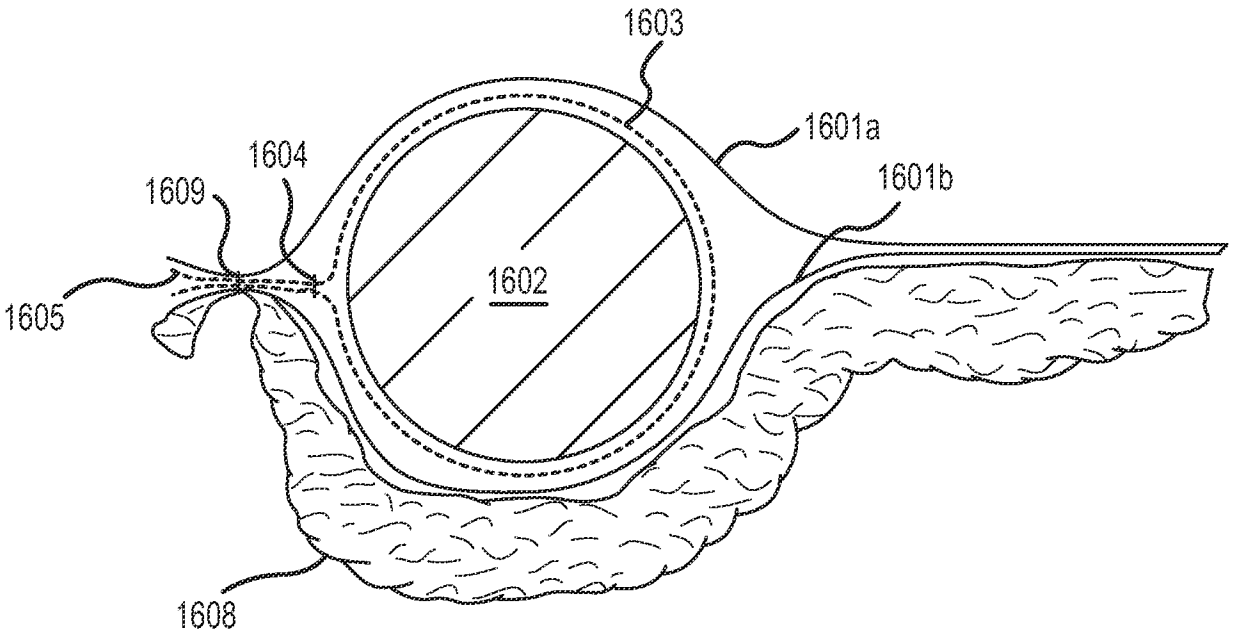
Figure 16C:
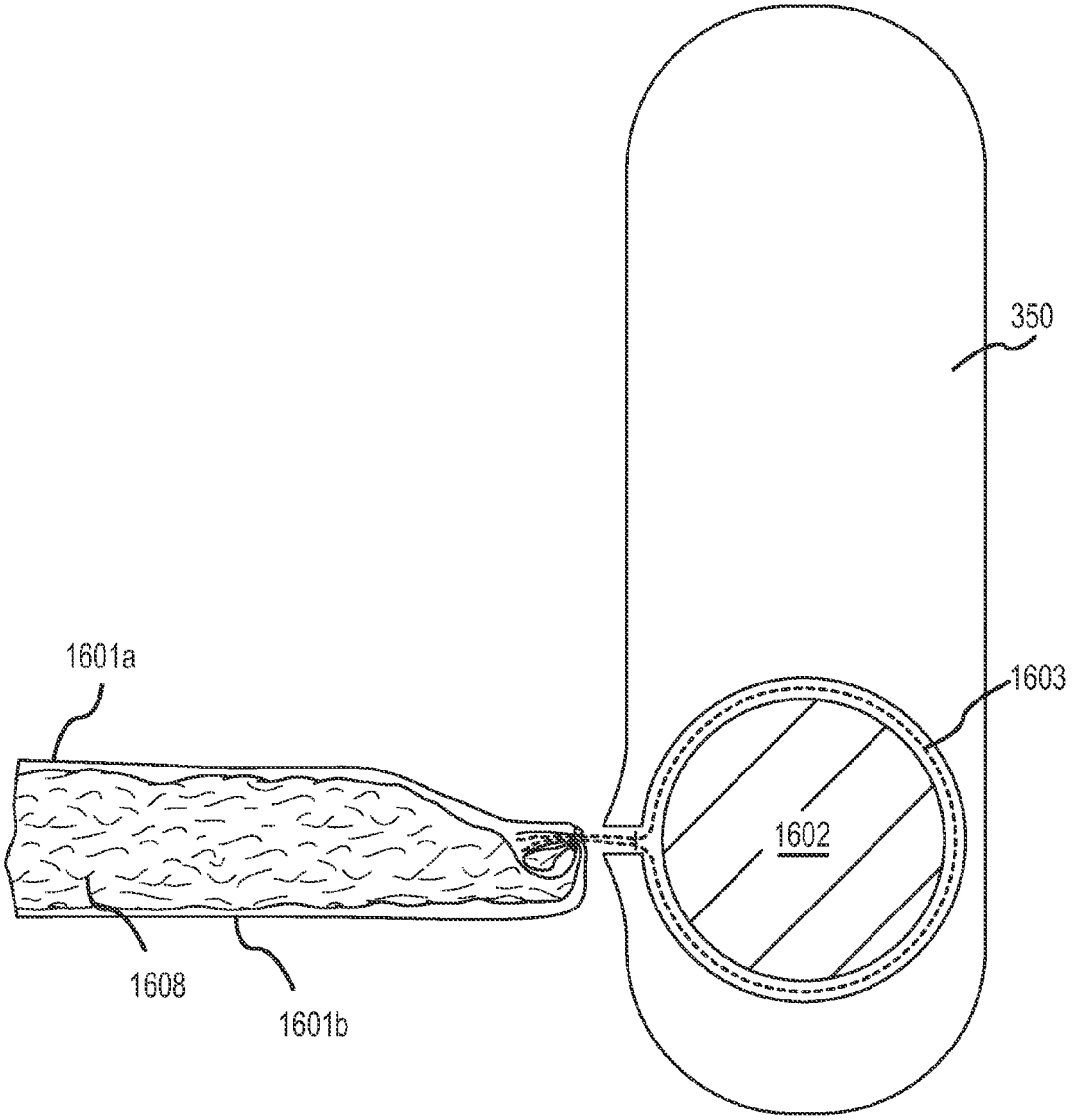
Figure 17:
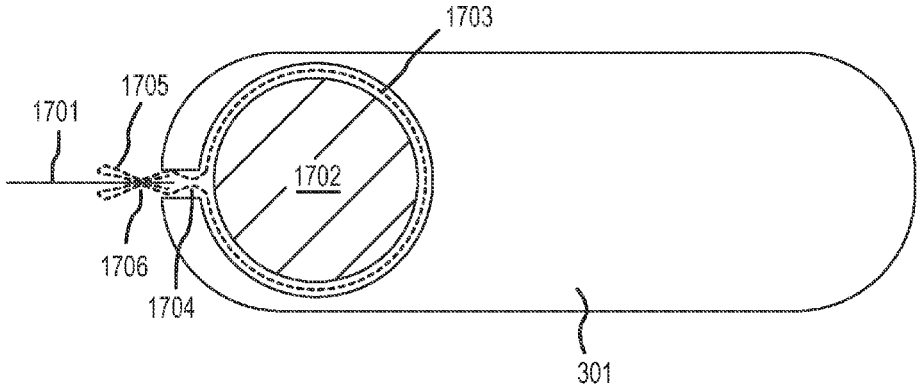
FIG. 17 illustrates an embodiment of attaching a track at an edge of a single-thickness piece of child care equipment.
Figure 18:
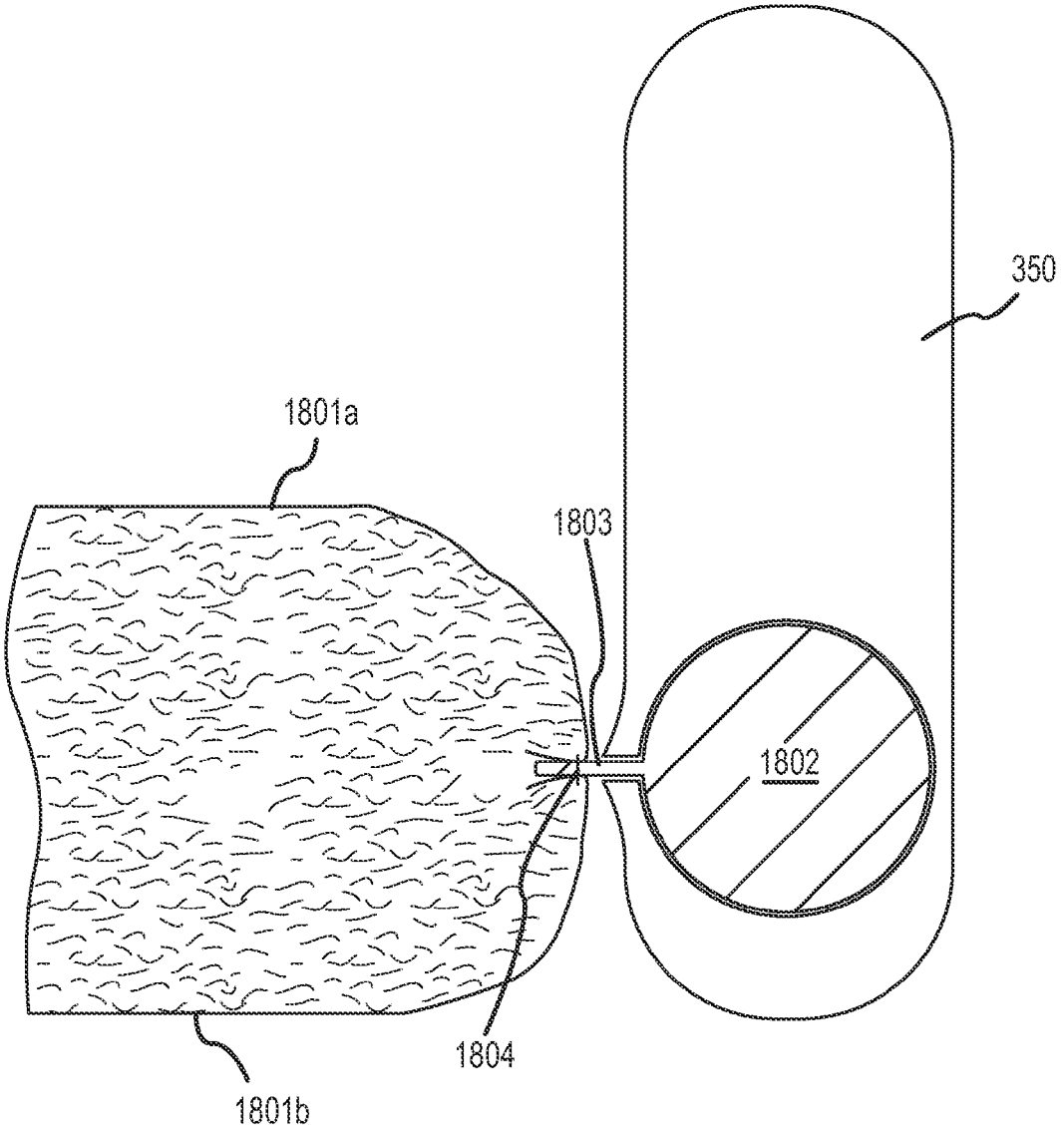
FIG. 18 shows another way of attaching a track to a piece of child care equipment, in accordance with embodiments of the invention.

FIGS. 16-18 illustrate additional details of how a track may be attached to a piece of child care equipment, for example pillow 1000 or slipcover 1400.

FIG. 16A shows one way of attaching a track at a seam in a piece of child care equipment having a shell with two layers 1601*a* and 1601*b*. In the view of FIG. 16A view, a rod or welt 1602 is shown in cross section, and serves as a track. For example, welt 1602 may be made of extruded, foam, plastic, or rubber. Rod or welt 1602 is wrapped in a sleeve 1603, shown in dashed lines. As is described above, sleeve 1603 may be made of a material having good durability and strength, for example nylon or another suitable material. Preferably, sleeve 1603 is sewn along stitching line 1604 to snugly capture rod or welt 1602 within sleeve 1603, leaving two layers of sleeve 1603 protruding to form a tab 1605.

In this example, the shell is made in two layers 1601*a* and 1601*b*, with a padding or fill material 1606 between them. In other embodiments, pillow 1000 could have other components, such as a gusset along the inner seam of midsection 1008, as described in co-pending U.S. patent application Ser. No. 12/204,956 of Littlehorn et al. filed Sep. 5, 2008, the entire disclosure of which is hereby incorporated by reference herein. During construction, the edges of layers 1601*a* and 1601*b* may be generally aligned with the edge of tab 1605, and the four thicknesses of materials (layers 1601*a* and 1601*b*, and two thicknesses of sleeve 1603) sewn together along stitching line 1607. It may be convenient to make the attachment of sleeve 1603 to the shell with the shell "inside out". Once the shell is nearly complete, it may be turned "outside out" and filled with padding or fill material 1606. In this way, any edges of layers 1601*a* and 1601*b* and sleeve 1603 that might be subject to fraying are inside the finished product. A clip 350 or other clip according to embodiments of the invention may be engaged with rod or welt 1602, and the ends of sleeve 1603 addressed to capture rod 1602 longitudinally. Alternatively, rather than sewing sleeve 1603 and layers 1601*a* and 1601*b* together in a single operation, rod or welt 1602 wrapped in sleeve 1603 may be sewn to either layer 1601*a* or 1601*b* in one operation, and then to the other layer in a later operation, so that there may be three stitching lines at a particular seam.

Rod or welt 1602 is preferably spaced from the body of the child care equipment by a distance D that is sufficient to enable clip 350 to slide freely without catching on layer 1601*a* or layer 1601*b*. For example, spacing D may be about 1/16 inch to about 1/4 inch, or more preferably about 1/8 inch to about 3/16 inch.

FIGS. 16B and 16C show another way of attaching a track to a piece of child care equipment, in accordance with other embodiments of the invention. The technique of FIGS. 16B and 16C may be especially useful for construction of items that are generally flat but include padding, for example play pads, liners for shopping carts or strollers, or other similar items.

In FIG. 16B, a rod or welt 1602 has been previously wrapped in sleeve 1603 and sleeve 1603 sewn along stitching line 1604 to capture rod or welt 1602. Shell layers 1601*a* and 1601*b* are then stacked together with tab 1605 of sleeve 1603. In addition, a layer of sheet batting or other padding 1608 is also stacked together with tab 1605 and shell layers 1601*a* and 1601*b*. In this configuration, the sides of layers 1601*a* and 1601*b* that will form the outside of the product are facing each other. The combined shell layers 1601*a* and 1601*b*, tab 1605 of sleeve 1603, and padding 1608 are stitched together along stitching line 1609, which may extend along a portion or nearly all of the perimeter of the product. The stitching operation is preferably done with the product "inside out", and a small portion of the perimeter of the product is left unsewn, to allow for turning the product "outside out".

FIG. 16C shows the arrangement of layers once the product is turned "outside out" and a clip 350 is attached. The small previously unsewn portion of the product perimeter may then be finished with outside stitching or other finishing. A clip such as clip 350 is assembled onto the track at any suitable stage of the process, but preferably before the ends of the track are fully finished.

FIG. 17 shows one way of attaching a track at an edge of a piece of child care equipment having a single layer of material 1701. In this view, a rod or welt 1702 is shown in cross section, and serves as a track. Rod or welt 1702 is wrapped in a sleeve 1703, shown in dashed lines. Preferably, sleeve 1703 is sewn along stitching line 1704 to snugly capture rod or welt 1702 within sleeve 1703, leaving two layers of sleeve 1703 protruding to form a tab 1705. Each of the two layers of tab 1705 may then be folded under, and the single layer of material 1701 inserted between them, and the five resulting layers of material sewn together along stitching line 1706. In this way, any edges of material 1701 or sleeve 1703 that might be subject to fraying are captured and hidden within tab 1705, between stitching lines 1704 and 1706. Alternatively, sleeve 1703 could be made of a self-edged material, and material 1701 simply sewn between the two thicknesses of tab 1705, leaving the edges of sleeve 1703 exposed. A clip 301 or other clip according to embodiments of the invention may be engaged with rod or welt 1702, and the ends of sleeve 1703 addressed to capture rod or welt 1702 longitudinally. It will be recognized that this technique could also be used to attach a track at an edge of a piece of child care equipment having multiple layers capable of being captured within tab 1705.

FIG. 18 shows another way of attaching a track to a piece of child care equipment having a shell with two layers 1801*a* and 1801*b*. In this view, a welt 1802 is shown in cross section, and serves as the track. Welt 1802 is extruded, for example of foam, plastic, or rubber, to include an integrally formed flange 1803. Flange 1803 may be used to attach welt 1802 to layers 1801*a* and 1801*b* by sewing flange 1803 into the seam between layers 1801*a* and 1801*b*. The sewing may be done simultaneously, such as along stitching line 1804 capturing layers 1801*a* and 1801*b* and flange 1803 in a single pass, or flange 1803 may be sewn to the layers one at a time. Flange 1803 enables welt 1802 to be attached without being wrapped in a sleeve. The main portion of welt 1802 (to which flange 1803 is connected), could be hollow, for example forming a tube with an opening along its length, or may be fully formed of the welt material, without any hollow portion. It will be recognized that welt 1802 having flange 1803 could also be attached to a single layer shell, or to a multiple-layer shell with both layers on the same side of flange 1803. Many other configurations are possible. Welt 1802 having a flange 1803 may replace a sleeve-wrapped welt or rod in any suitable application, for example the applications shown in any of the Figures.

Figure 19A:
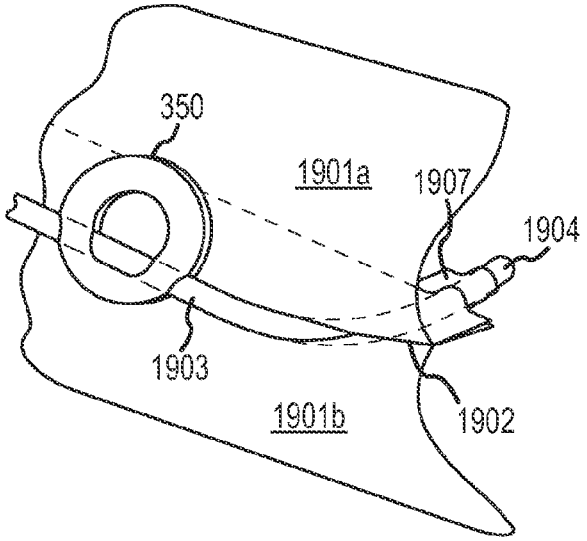
FIGS. 19A and 19B show a way of capturing the ends of a piece of foam welt in a seam, in accordance with embodiments of the invention
Figure 19B:
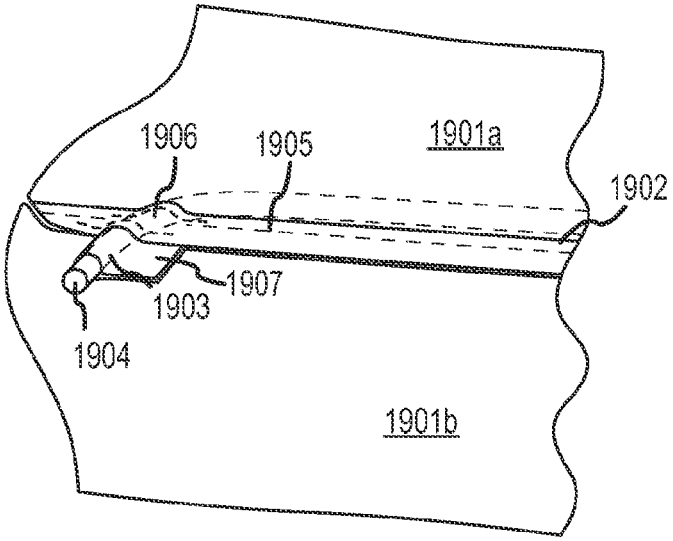

FIGS. 19A and 19B show a way of capturing the ends of a piece of welt in a seam between two fabric or other flexible layers 1901*a* and 1901*b*. FIG. 19A shows the assembly from the finished side of the seam, such as the outside of a product, and FIG. 19B shows the assembly from the unfinished side of the seam, such as would be found on the inside of a product. Layers 1901*a* and 1901*b* are joined along seam 1902. For much of the seam visible in FIGS. 19A and 19B, a track 1903 is sewn into seam 1902, for example by wrapping a piece of welt in a fabric sleeve 1907 and sewing the sleeve into seam 1902 as described above. At a point where it is desired that track 1903 ends, track 1903 is turned inward, so that end 1904 of track 1903 will reside inside the finished product. Stitching 1905 is simply continued across track 1903 to capture track 1903 securely in seam 1902. The point at which track 1903 is turned inward also provides a stop that prevents clip such as clip 350 from sliding past that point or from coming off of track 1903. If desired, multiple stitching passes 1906 may be made over track 1903 to lend strength to the connection.

The invention has now been described in detail for the purposes of clarity and understanding. However, those skilled in the art will appreciate that certain changes and modifications may be practiced within the scope of the appended claims.

What is claimed is:

1. A pillow, comprising:

a compressible fill material;

a flexible shell covering the compressible fill material;

a track comprising a flexible rod-like member having first and second ends and a cross-sectional shape and coupled to the flexible shell with the first and second ends embedded within the flexible shell; and at least one clip slidingly engaged with the track, the clip defining an opening for detachably receiving an item so as to attach the item to the pillow and including a passage that extends at least partially through the clip and that is configured to receive the track, wherein the passage comprises a cross-sectional shape substantially the same as the cross-sectional shape of the track.

2. The pillow of claim 1, wherein the at least one clip further includes:

a generally toroidal enclosed body that extends in a plane; and a slot in communication with the passage wherein the slot extends into the body generally perpendicular to the plane.

3. The pillow of claim 1, wherein the track comprises a welt having at least a portion with a substantially circular cross section.

4. The pillow of claim 3, wherein the welt is made of foam, rubber, or plastic.

5. The pillow of claim 3, wherein the welt includes an integrally formed flange.

6. The pillow of claim 1, wherein the track is at least partially embedded by wrapping it in a fabric sleeve that is part of the flexible shell.

7. The pillow of claim 1, wherein the track is at least partially embedded in a seam of the flexible shell.

8. The pillow of claim 1, wherein the flexible shell is a fabric shell.

9. The pillow of claim 1, in combination with an item attached to the pillow via the clip.

10. The combination of claim 9, wherein the item comprises an item selected from the group consisting of a toy, a doll, a ball, a mirror, a block, a pyramid, a teething ring, a toy shaped like an animal or insect, a toy shaped like a plant or flower, an item that generates sound, an item that generates vibration, and an item that generates light.

11. The pillow of claim 1, in combination with an item to be attached to the pillow, the item comprising a main body larger than the opening in the clip, and the item including a compressible member connected to the main body, wherein the compressible member is larger than the opening when the compressible member is in an uncompressed state, and the compressible member is configured to be compressible to a size smaller than the opening so that the compressible member can be passed through the opening to place the compressible member and the main body on opposite sides of the opening.

12. The pillow of claim 1, wherein the pillow is generally arc shaped, having two curved arms extending from a midsection, to define an open well.

13. A method of attaching an item to a pillow, the method comprising:

providing a pillow that includes a flexible shell material covering a compressible fill material, the pillow further including a track comprising a flexible rod-like member with unconnected and unexposed ends having a cross-sectional shape and coupled to the flexible shell at a seam by a separate material covering the track, and a clip slidingly engaged with the track, the clip defining an opening for detachably receiving an item so as to attach the item to the pillow and including a passage that extends at least partially through the clip and that is configured to receive the track, wherein the passage comprises a cross-sectional shape substantially the same as the cross-sectional shape of the track;

providing an item to be attached to the pillow; and attaching the item to the pillow via the clip.

14. A slipcover for a pillow, the slipcover comprising:

a flexible shell configured to conform to an outer shape of a particular pillow;

a track covered by a flexible material and comprising a flexible rod-like member having a cross-sectional shape and a first and second end, wherein the track is coupled to the flexible shell at a seam by the flexible material with the first and second end embedded within the flexible shell; and a clip slidingly engaged with the flexible material, the clip defining an opening for detachably receiving an item so as to attach the item to the slipcover and including a passage that extends at least partially through the clip and that is configured to receive the covered track, wherein the passage comprises a cross-sectional shape substantially the same as the cross-sectional shape of the track.

15. The slipcover of claim 14, in combination with an item attached to the slip cover via the clip.

16. The combination of claim 15, further in combination with a pillow to which the flexible shell is configured to conform.

17. The combination of claim 15, wherein the item comprises an item selected from the group consisting of a toy, a doll, a ball, a mirror, a block, a pyramid, a teething ring, a toy shaped like an animal or insect, a toy shaped like a plant or flower, an item that generates sound, an item that generates vibration, and an item that generates light.

18. The slipcover of claim 14, in combination with an item to be attached to the slipcover, the item comprising a main body larger than the opening in the clip, and the item including a compressible member connected to the main body, wherein the compressible member is larger than the opening when the compressible member is in an uncompressed state, and the compressible member is configured to be compressible to a size smaller than the opening so that the compressible member can be passed through the opening to place the compressible member and the main body on opposite sides of the opening.

19. The slipcover of claim 14, wherein the flexible shell is a fabric shell.

20. A method of attaching an item to a pillow, the method comprising:

providing a pillow;

providing a slipcover configured to generally conform to and cover the outer shape of the pillow, the slipcover including a track comprising a flexible rod-like member having a cross-sectional shape and coupled to the flexible shell of the slipcover with ends of the track embedded within the slipcover and a clip slidingly engaged with the track, the clip defining an opening for detachably receiving an item so as to attach the item to the slipcover and including a passage that extends at least partially through the clip and that is configured to receive the track, wherein the passage comprises a cross-sectional shape substantially the same as the cross-sectional shape of the track;

inserting the pillow into the slipcover;

providing an item to be attached to the slipcover; and attaching the item to the slipcover via the clip.

21. The method of claim 20, further comprising adjusting the position of the item by sliding the clip along the track.

22. The method of claim 20, wherein attaching the item to the slipcover via the clip further comprises:

compressing a compressible member of the item;

passing the compressible member through the opening in the clip; and allowing the compressible member to re-expand.

23. A pillow, comprising:

a pillow body comprising a compressible fill material and a flexible shell covering the compressible fill material, wherein the pillow body comprises a medial region with two arms extending from the medial region and includes a curved outer periphery and a curved inner periphery;

a track comprising a flexible rod-like member having a cross-sectional shape and coupled to the flexible shell, wherein the track extends along a major portion of the outer periphery at the medial region and has ends that are embedded within the pillow body; and at least one clip slidingly engaged with the track, wherein the clip is sized and shaped for attaching an item to the pillow, wherein the clip comprises a body and a passage that extends at least partially through the body for receiving and at least partially surrounding the track, and wherein the passage comprises a cross-sectional shape that is substantially the same as the cross-sectional shape of the track.

24. The pillow of claim 23, wherein the clip body is a generally toroidal enclosed body extending in a plane and defining an opening for attaching an item to the pillow.

25. The pillow of claim 24, wherein the clip further comprises a slot extending into the clip body generally perpendicular to the plane of the generally toroidal body.

26. The pillow of claim 23, wherein the track is at least partially embedded by wrapping it in a fabric sleeve that is part of the flexible shell.

27. The pillow of claim 23, wherein the track comprises a welt having an integrally formed flange.

28. A slipcover for a pillow, the slipcover comprising:

a flexible shell configured to conform to an outer shape of a pillow that comprises a medial region with two arms extending from the medial region and includes a curved outer periphery and a curved inner periphery;

a track comprising a flexible rod-like member having a cross-sectional shape and coupled to the flexible shell, wherein the track has ends that are embedded within the slipcover and extends along a major portion of the outer periphery at the medial region; and a clip slidingly engaged with the track, wherein the clip is sized and shaped for attaching an item to the pillow, wherein the clip comprises a body and a passage that extends at least partially through the body for receiving and at least partially surrounding the track, and wherein the passage comprises a cross-sectional shape that is substantially the same as the cross-sectional shape of the track.

29. The slipcover of claim 28, wherein the clip body is a generally toroidal enclosed body extending in a plane and defining an opening for attaching an item to the slipcover.

30. The slipcover of claim 29, wherein the clip further comprises a slot extending into the clip body generally perpendicular to the plane of the generally toroidal body.

31. The slipcover of claim 28, wherein the track is at least partially embedded by wrapping it in a fabric sleeve that is part of or joined to the flexible shell.

32. The slipcover of claim 28, wherein the track comprises a welt having an integrally formed flange.

33. The pillow of claim 1, wherein the passage is sized so that the at least one clip can slide along the track but will maintain its position on the track when left at rest.

* * * * *